US011304553B2

(12) United States Patent
Riedel et al.

(10) Patent No.: US 11,304,553 B2
(45) Date of Patent: Apr. 19, 2022

(54) HANGER SYSTEM WITH HANGER COUPLING MEMBER

(71) Applicant: TARGET BRANDS, INC., Minneapolis, MN (US)

(72) Inventors: Richard P. Riedel, Blaine, MN (US); Terrence J. Hornsby, Jr., Minneapolis, MN (US); Jeremy A. Clark, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 162 days.

(21) Appl. No.: 16/545,810

(22) Filed: Aug. 20, 2019

(65) Prior Publication Data

US 2020/0085221 A1 Mar. 19, 2020

Related U.S. Application Data

(60) Provisional application No. 62/732,382, filed on Sep. 17, 2018.

(51) Int. Cl.

| | |
|---|---|
| ***A47G 25/18*** | (2006.01) |
| ***A47G 25/16*** | (2006.01) |
| ***A47G 25/48*** | (2006.01) |

(52) U.S. Cl.

CPC ..... *A47G 25/186* (2013.01); *A47G 25/16* (2013.01); *A47G 25/481* (2013.01)

(58) Field of Classification Search

CPC .... A47G 25/186; A47G 25/16; A47G 25/481; A47G 25/14; A47G 25/1407; A47G 1428/1435; A47G 25/18; A47G 25/183; A47G 25/48; A47G 25/482; A47G 25/483

USPC ..... 223/88, 89, 91, 95

See application file for complete search history.

(56) References Cited

U.S. PATENT DOCUMENTS

| | | | |
|---|---|---|---|
| D41,344 | S | 5/1911 | Gilman |
| D59,688 | S | 11/1921 | Shannon |
| 1,906,979 | A | 5/1933 | Levin |
| D115,919 | S | 8/1939 | Fewster |
| D131,791 | S | 3/1942 | Rhodes |
| 2,440,637 | A | 4/1948 | Lowe |
| 2,496,651 | A | 2/1950 | Saunders |
| 2,522,013 | A | 9/1950 | Anderson |

(Continued)

FOREIGN PATENT DOCUMENTS

GB 2191393 A 12/1987

*Primary Examiner* — F Griffin Hall

(74) *Attorney, Agent, or Firm* — JoAnn M. Seaton; Griffiths & Seaton PLLC

(57) ABSTRACT

A hanger assembly includes a primary hanger, an auxiliary hanger, and a coupling member. The primary hanger includes a hook configured to selectively receive a support rod, a pair of arms coupled to the hook and extending outwardly therefrom to form two, opposite free arm ends. The pair of arms defines an interior coupling cavity extending into an interior of the pair of arms upwardly from bottom edges of the pair of arms. The auxiliary hanger is configured to support a garment. The coupling member defines a first end and a second end opposite and spaced from the first end. The first end of the coupling member includes a first clip selectively secured within the interior coupling cavity of the primary hanger substantially above the bottom edges of the pair of arms. The second end of the coupling member is secured to the auxiliary hanger.

19 Claims, 16 Drawing Sheets

(56) References Cited

U.S. PATENT DOCUMENTS

D195,445 S 6/1963 Warmath
D202,484 S 10/1965 Helms, Jr.
3,301,447 A 1/1967 Felton
3,946,915 A 3/1976 Crane
D243,138 S 1/1977 Coon
4,034,902 A 7/1977 Grillo
4,227,632 A 10/1980 Collis
4,295,585 A 10/1981 Garrison
D271,649 S 12/1983 Batts et al.
D293,514 S 1/1988 Hurrelbrink
D301,661 S 6/1989 Wilson
D301,808 S 6/1989 Marshall
D301,942 S 7/1989 Talbot-Titley
D301,943 S 7/1989 Wilson
D302,214 S 7/1989 Wilson
D303,325 S 9/1989 Marshall
5,029,739 A 7/1991 Blanchard et al.
5,062,556 A 11/1991 Willputz
5,071,045 A 12/1991 Hollis
5,082,153 A 1/1992 Duester et al.
D323,588 S 2/1992 Pelosi
D325,822 S 5/1992 Hollis
D328,194 S 7/1992 Garrison
D352,834 S 11/1994 Norman
5,400,932 A 3/1995 Hollis
5,516,014 A 5/1996 Garrison
5,603,438 A 2/1997 Jugan
5,613,630 A 3/1997 Senga et al.
5,806,728 A 9/1998 Forsstrom et al.
5,890,634 A 4/1999 Zuckerman et al.
D414,044 S 9/1999 Choi et al.
D414,946 S 10/1999 Gouldson
D415,357 S 10/1999 Blanchard
6,019,261 A 2/2000 Morgan et al.
D423,235 S 4/2000 Bond et al.
6,050,461 A 4/2000 Batts et al.
6,065,652 A 5/2000 Dooling-Sherman
D429,898 S 8/2000 Morgan et al.
D433,822 S 11/2000 Sullivan
6,142,347 A 11/2000 Kolton et al.
D435,173 S 12/2000 Morgan et al.
D436,743 S 1/2001 Batts et al.
D439,419 S 3/2001 Zuckerman
6,202,906 B1 3/2001 Zuckerman
D440,777 S 4/2001 Giustini
D443,424 S 6/2001 Eiley et al.
6,241,133 B1 6/2001 Morgan et al.
6,286,735 B1 9/2001 Zuckerman
D450,463 S 11/2001 Wong et al.
6,382,478 B2 5/2002 Gouldson et al.
D463,918 S 10/2002 Goldman et al.
D464,814 S 10/2002 De Winter et al.
6,457,615 B1 10/2002 Lam
6,467,658 B1 10/2002 Olk et al.
6,499,634 B2 12/2002 Olk et al.
D472,062 S 3/2003 Yegavian et al.
6,612,000 B2 9/2003 Housley
6,622,897 B2 9/2003 Bokmiller et al.
D498,936 S 11/2004 Gouldson
D499,559 S 12/2004 Schultz et al.
D500,412 S 1/2005 Gouldson
D502,007 S 2/2005 Schultz et al.
D502,009 S 2/2005 Gouldson
D502,011 S 2/2005 Gouldson
D502,328 S 3/2005 Gouldson
D503,545 S 4/2005 Gosselin et al.
D504,024 S 4/2005 Mainetti
D504,239 S 4/2005 Gosselin et al.
6,896,163 B2 5/2005 Louw
D506,320 S 6/2005 Gouldson
D507,418 S 7/2005 Mainetti
D507,419 S 7/2005 Gouldson
D511,049 S 11/2005 Gouldson
D512,571 S 12/2005 Gouldson et al.
D518,839 S 4/2006 Singleton
D519,139 S 4/2006 Singleton
7,089,599 B2 8/2006 Gouldson et al.
7,104,428 B2 9/2006 Gouldson
7,121,439 B2 10/2006 Gouldson et al.
7,182,232 B2 2/2007 Fleming et al.
7,290,687 B2 11/2007 Wu
7,387,223 B2 6/2008 Misumi
7,455,203 B2 11/2008 Gouldson et al.
7,537,142 B2 5/2009 Yau et al.
7,556,180 B1 7/2009 Hansen et al.
D601,356 S 10/2009 Jones
D606,322 S 12/2009 Jones
D606,324 S 12/2009 Jones
D606,764 S 12/2009 Warren
D606,765 S 12/2009 Warren
D606,766 S 12/2009 Warren
D607,216 S 1/2010 Niccol
D607,217 S 1/2010 Warren
D607,218 S 1/2010 Warren
D612,619 S 3/2010 Gouldson
D612,620 S 3/2010 Gouldson
D613,078 S 4/2010 Gouldson
D616,652 S 6/2010 Warren
D622,972 S 9/2010 Jones
D623,867 S 9/2010 Fort et al.
7,832,603 B2 11/2010 Gouldson
7,832,604 B2 * 11/2010 Gouldson ..... A47G 25/16
223/88
7,837,074 B2 11/2010 Rude et al.
D628,818 S 12/2010 Warren
D628,819 S 12/2010 Mazzotta
D628,822 S 12/2010 Warren
7,938,300 B2 5/2011 Diamond et al.
D655,924 S 3/2012 Gouldson
8,267,287 B2 9/2012 Gouldson
D670,920 S 11/2012 Jones
D681,352 S 5/2013 Jones
D684,383 S 6/2013 Chan
D712,166 S 9/2014 Gouldson
D716,062 S 10/2014 Gouldson
8,925,770 B1 1/2015 Garcia
D727,635 S 4/2015 Atkinson
D727,636 S 4/2015 Atkinson
9,027,804 B2 5/2015 Barre et al.
9,282,839 B2 3/2016 Rakhamimov et al.
D759,391 S 6/2016 Jones
9,386,873 B2 7/2016 Gouldson
D770,189 S 11/2016 Choy
9,510,702 B2 12/2016 Yau
D804,198 S 12/2017 Jones
D815,845 S 4/2018 Clark et al.
D816,351 S 5/2018 Clark et al.
D826,582 S 8/2018 Clark et al.
D831,986 S 10/2018 Clark et al.
D831,987 S 10/2018 Clark et al.
D832,600 S 11/2018 Clark et al.
D843,740 S 3/2019 Peterson et al.
D843,741 S 3/2019 Clark et al.
D843,742 S 3/2019 Clark et al.
D846,893 S 4/2019 Clark et al.
2001/0016994 A1 8/2001 Gouldson et al.
2002/0108975 A1 8/2002 Hunt et al.
2003/0141374 A1 7/2003 Matkovich
2003/0192924 A1 10/2003 White
2003/0209577 A1 11/2003 Gouldson et al.
2004/0099700 A1 5/2004 Misumi
2004/0112929 A1 6/2004 Frassinelli
2004/0188475 A1 9/2004 Gouldson
2004/0256425 A1 12/2004 Barre et al.
2006/0163294 A1 7/2006 Sutton et al.
2006/0278671 A1 12/2006 Gouldson
2007/0075104 A1 4/2007 Yau
2007/0246490 A1 10/2007 Gouldson
2008/0283558 A1 11/2008 Rude et al.
2008/0296324 A1 12/2008 Zhao et al.
2009/0045232 A1 2/2009 Gray
2009/0078726 A1 3/2009 Boulet et al.
2010/0193553 A1 8/2010 Gouldson
2010/0252588 A1 10/2010 Gouldson et al.

(56) References Cited

U.S. PATENT DOCUMENTS

| | | | |
|---|---|---|---|
| 2011/0057001 | A1 | 3/2011 | Louw |
| 2011/0284597 | A1 | 11/2011 | Kaleta et al. |
| 2015/0060500 | A1 | 3/2015 | Yau |
| 2015/0297011 | A1 | 10/2015 | Jones |
| 2016/0051072 | A1 | 2/2016 | Gouldson |
| 2018/0103785 | A1 | 4/2018 | Goldman et al. |
| 2018/0325299 | A1 | 11/2018 | Clark et al. |

* cited by examiner

HANGER SYSTEM WITH HANGER COUPLING MEMBER

CROSS-REFERENCE TO RELATED APPLICATION

This application is a non-provisional application of and claims priority to U.S. Provisional Patent Application No. 62/732,382, filed Sep. 17, 2018, which is incorporated herein by reference.

This application is related to U.S. Design patent application No. 29/663,589, filed Sep. 17, 2018; U.S. Design patent application No. 29/663,593, filed Sep. 17, 2018; and U.S. Design patent application No. 29/698,666, filed Jul. 18, 2019, which is a divisional application of U.S. Design patent application No. 29/663,593, filed Sep. 17, 2018

BACKGROUND OF THE INVENTION

Hangers are often used to support clothing and other garments for storage and display of the garments in retail stores as well as for storage in a consumer's home following purchase. Such hangers with garments are typically hung from a support rod along with a plurality of other hangers supporting other similar garments and/or garments of various shapes and sizes. The different sizes and configuration of garments are most effectively hung on hangers adapted for the particular garment.

Oftentimes, more than one garment of the same or different types are grouped together to form an outfit, coordinating garment options, or other multiple garment collection. In retail sale, it is often desirable to offer a collection of two or more garments as a single retail set hung from a single hook on a support rod. Using individualized hangers for each of the various configurations of garments depended from a single hook incurs a need for a relatively large inventory of hanger types that can be difficult to manage.

SUMMARY

One embodiment of the present invention relates to a hanger assembly including a primary hanger, an auxiliary hanger, and a coupling member. The primary hanger includes a hook configured to selectively receive a support rod, a pair of arms coupled to the hook and extending outwardly therefrom to form two, opposite free arm ends. The pair of arms defines an interior coupling cavity extending into an interior of the pair of arms upwardly from bottom edges of the pair of arms. The auxiliary hanger is configured to support a garment. The coupling member defines a first end and a second end opposite and spaced from the first end. The first end of the coupling member includes a first clip selectively secured within the interior coupling cavity of the primary hanger substantially above the bottom edges of the pair of arms. The second end of the coupling member is secured to the auxiliary hanger. Other hangers, securement elements, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the term "about" or "substantially" applies to all numeric values or descriptive terms, respectively, and generally indicate a range of numbers or characteristics that one of skill in the art would consider equivalent to the recited values or terms, that is, having the same function or results.

This innovation provides a hanger system, such as a hanger system for supporting multiple garment or items from a single hook for retail sale or otherwise that allows primary hangers, including hooks for receiving a support bar, to be selectively coupled with different auxiliary hangers not having their own hooks. Each auxiliary hanger depends from a corresponding primary hanger via an elongated coupling member. Each coupling member is configured to lock within a coupling cavity that is formed within the typical form factor of each of the primary hanger and the auxiliary hanger to collectively create a hanger assembly. Each of primary hanger and auxiliary hanger are configured to independently support and maintain one or more garments. In one embodiment, multiple types of primary hangers and multiple types of auxiliary hangers are part of hanger system and can be mix and matched with one another and coupled via a single type of coupling member to form a variety of hanger assemblies each including a different combination of primary hanger and auxiliary hanger, but using a substantially identical coupling member to couple the two hangers together.

The flexibility of the hanger system, for example, of the embodiments described herein, allows a particular combination of hangers in the hanger assembly to be customized for each particular garment combination without requiring a different inventoried hanger for each conceivable garment combination. In one embodiment, hanger system is configured for use in retail sale to display coordinating or garments otherwise grouped to be sold at retail as a single unit. Other advantages and features are further described below.

Figure 1:
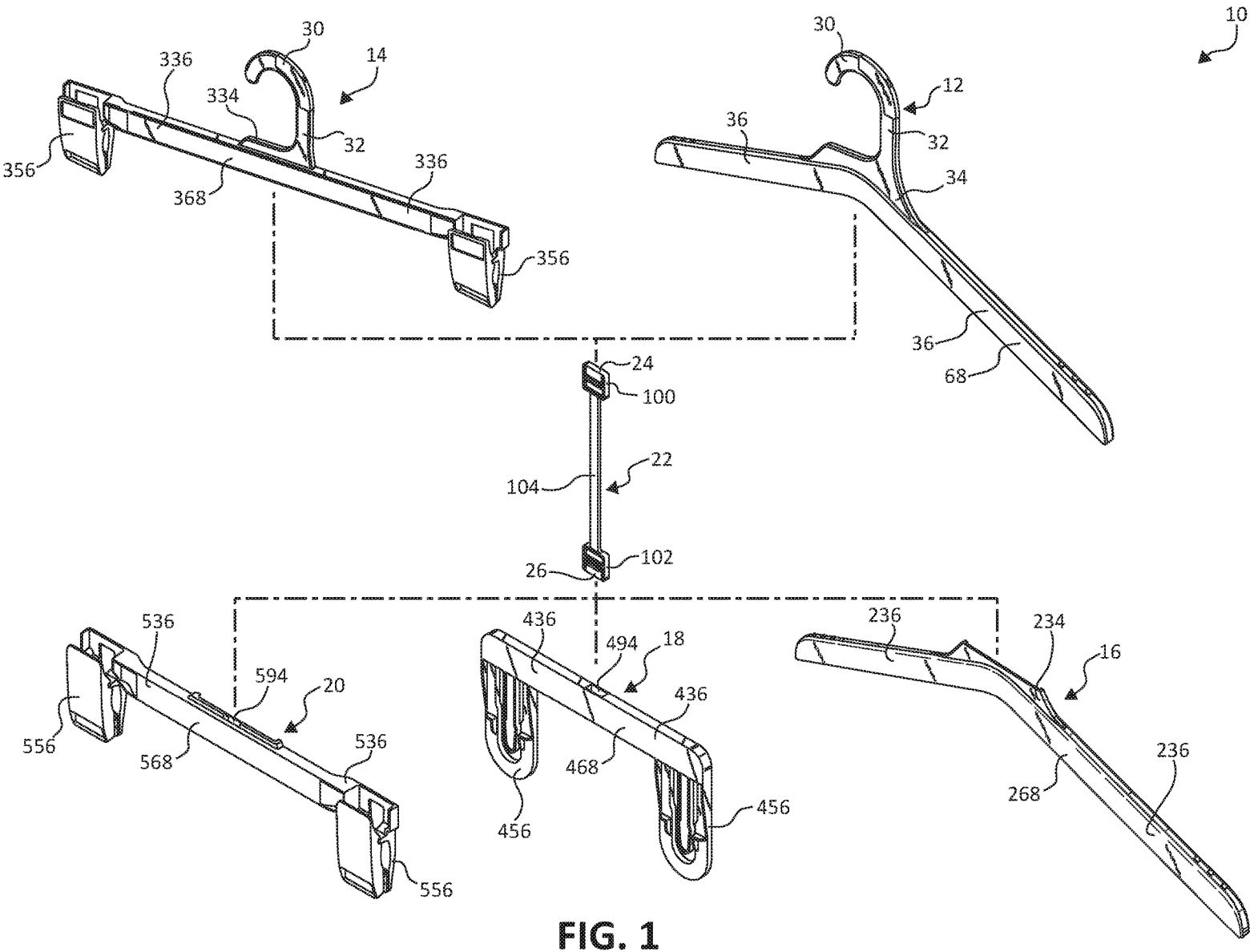
FIG. 1 is a front perspective view illustration of hanger system, according to one embodiment of the present invention.

Turning to the Figures, FIG. 1 illustrates a hanger system 10 including one or more primary hangers, such as a primary hanger 12 and a primary hanger 14, one or more auxiliary hangers, such as an auxiliary hanger 16, an auxiliary hanger 18, and an auxiliary hanger 20, and a coupling member 22. Each of primary hangers 12 and 14 is configured to receive and be supported by, for example, to be hung from a support rod or other suitable support (not shown) as will be apparent to those of skill in the art. Coupling member 22 includes a first end 24 configured to be selectively coupled to either one of primary hangers 12 and 14 to hang from the respective one of primary hangers 12 and 14. Coupling member 22 additionally includes a second end 26, opposite first end 24, configured to be selectively coupled with any one of auxiliary hangers 16, 18, and 20. In this manner, in one example, any one of primary hangers 12 and 14 is selectively couplable with any one of auxiliary hangers 16, 18, and 20 via coupling member 22 to form a hanger assembly, such as one of hanger assembly 28A illustrated in FIG. 2A, hanger assembly 28B illustrated in FIG. 2B, and hanger assembly 28C illustrated in FIG. 2C. In one example, all of hanger system 10 components are formed of a suitable polymer or other moldable material as will be apparent to those of skill in the art upon reading this application.

Figures 3, 4:
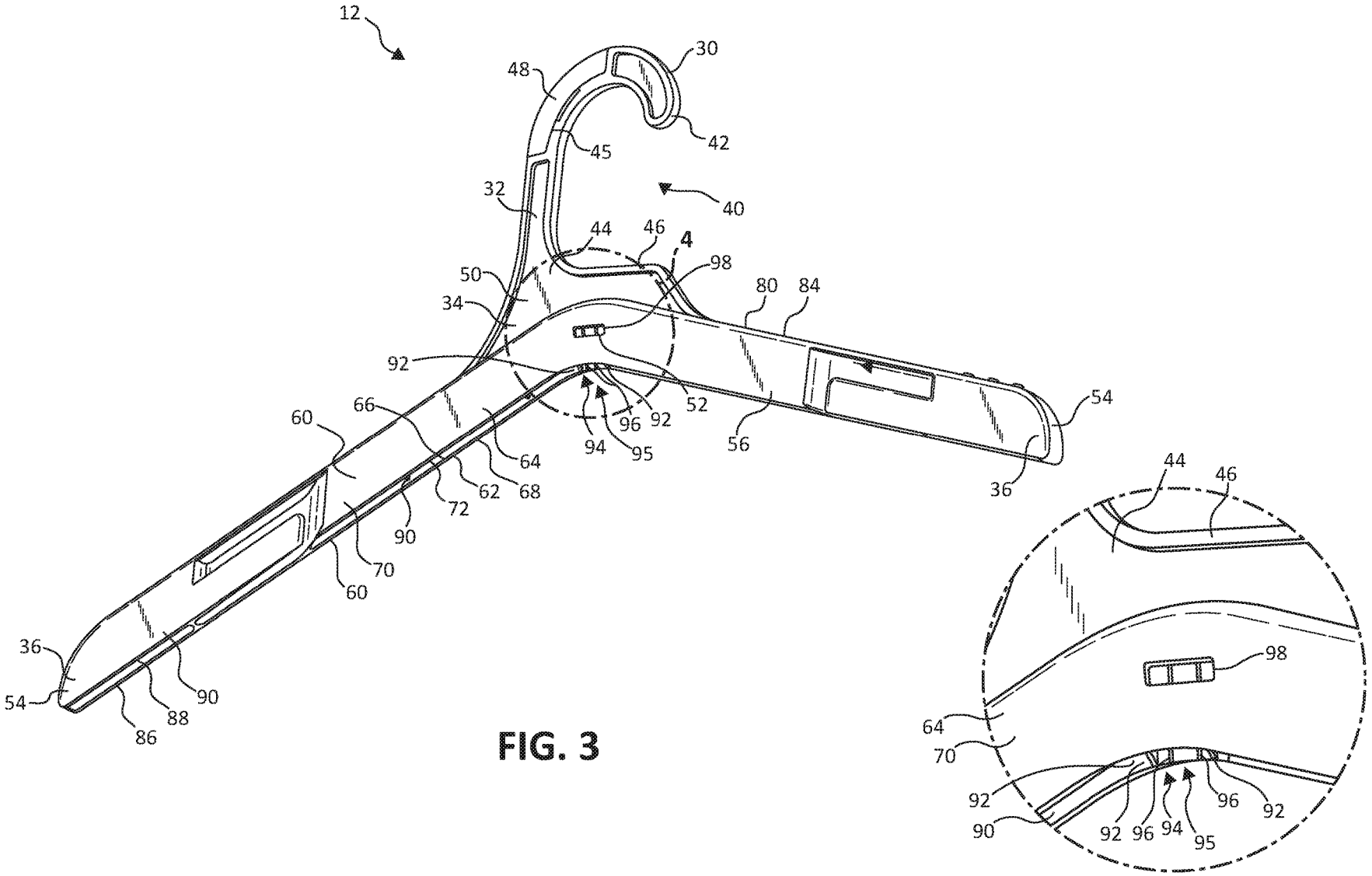
FIG. 3 is a rear perspective view illustration of one primary hanger of the hanger system of FIG. 1, according to one embodiment of the present invention.
FIG. 4 is a detailed view illustration of a portion of the one primary hanger generally indicated by circle 4 in FIG. 3, according to one embodiment of the present invention.
Figures 5, 6, 7, 8:
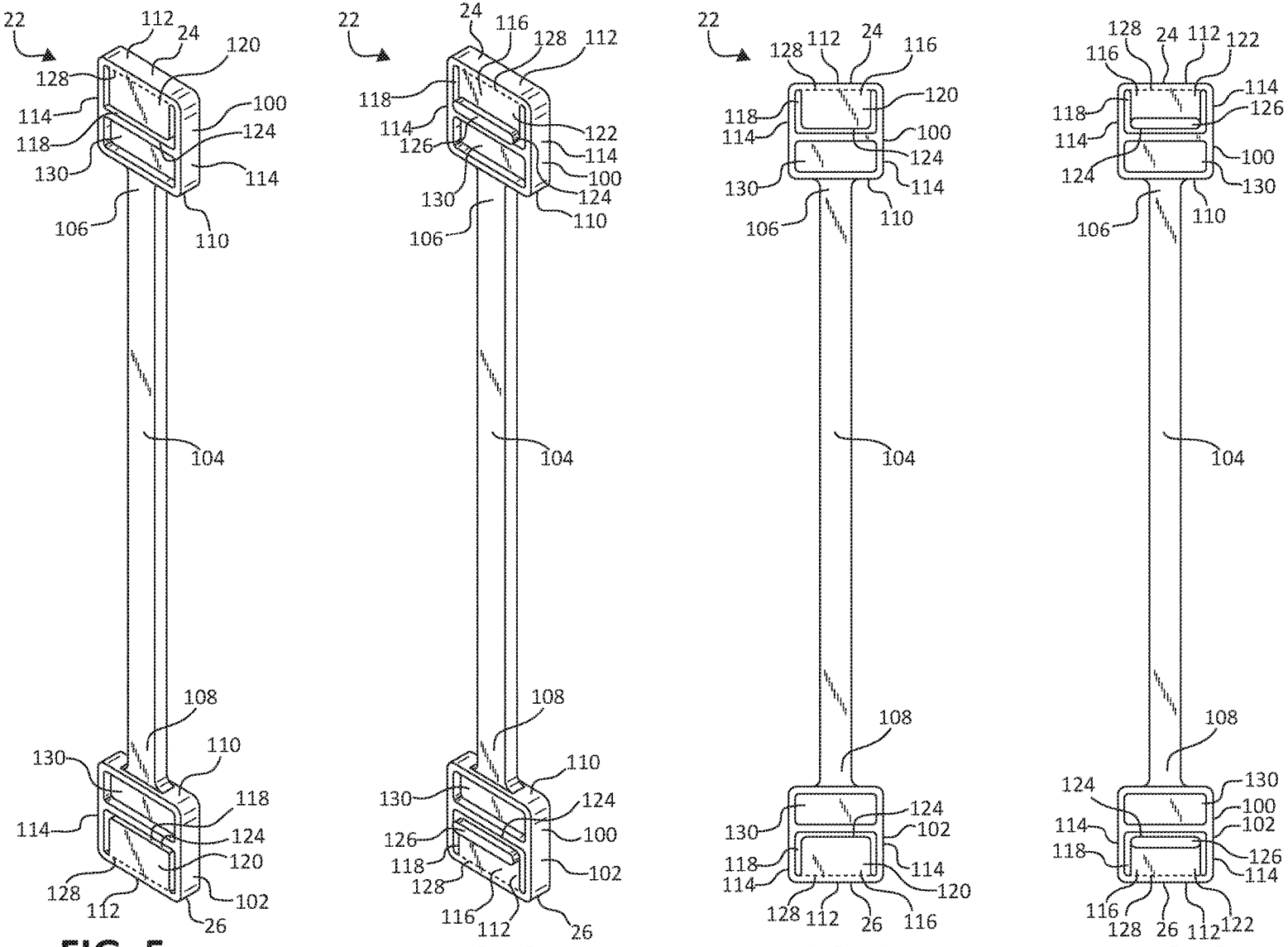
FIG. 5 is front, perspective view illustration of the coupling member of the hanger system of FIG. 1, according to one embodiment of the present invention.
FIG. 6 is a rear, perspective view illustration of the coupling member of FIG. 5, according to one embodiment of the present invention.
FIG. 7 is a front view illustration of the coupling member of FIG. 5, according to one embodiment of the present invention.
FIG. 8 is a rear view illustration of the coupling member of FIG. 5, according to one embodiment of the present invention.
Figure 9:
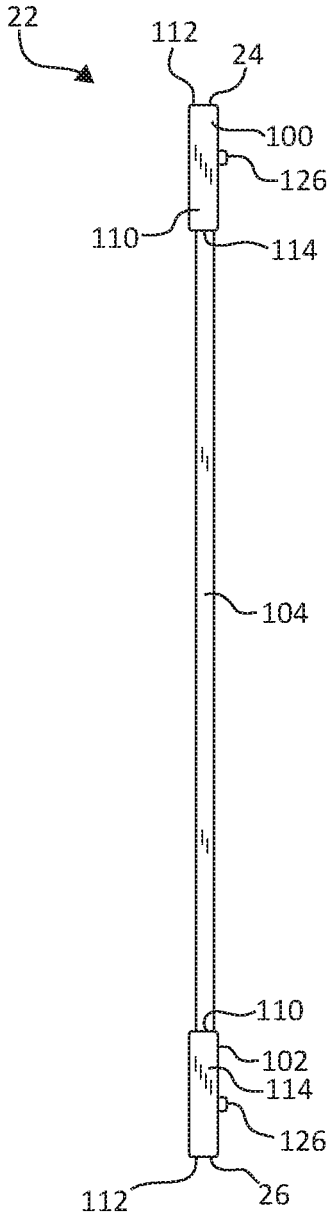
FIG. 9 is a right side view illustration of the coupling member of FIG. 5, according to one embodiment of the present invention.
Figure 10:
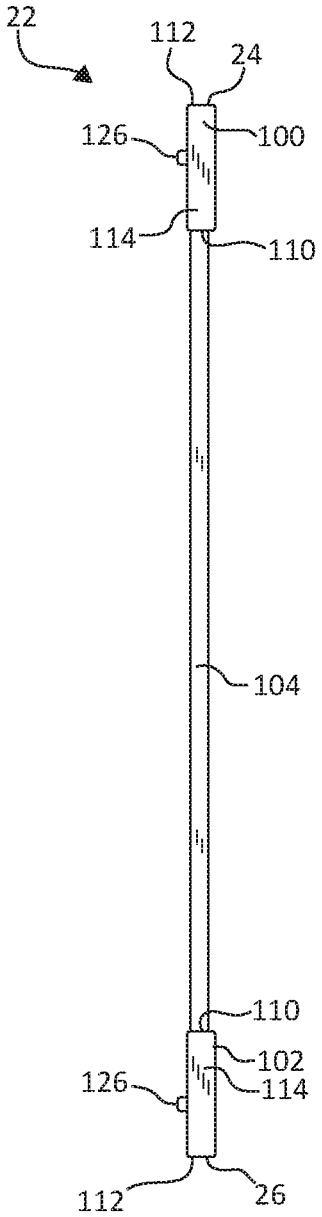
FIG. 10 is a left side view illustration of the coupling member of FIG. 5, according to one embodiment of the present invention.
Figure 11:
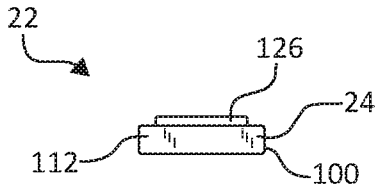
FIG. 11 is a top view illustration of the coupling member of FIG. 5, according to one embodiment of the present invention.
Figure 12:
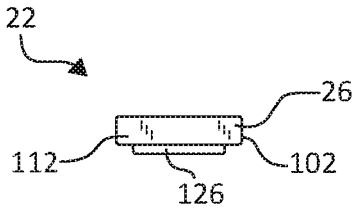
FIG. 12 is a bottom view illustration of the coupling member of FIG. 5, according to one embodiment of the present invention.

Primary hanger 12 includes a hook 30, a neck region 32, a shoulder region 34, and a pair of arms 36, according to one embodiment of the present invention. Hook 30 is curvilinear and defines an opening 40 at one side, opposite neck region 32, to receive a support rod (not shown). Hook 30 extends from a free hook end 42 to a neck region 32, which extends downwardly from hook 30 to a shoulder region 34. In one example, hook 30, neck region 32, and shoulder region 34 are collectively formed of a primary, planar panel 44. Perimeter flange 46, in the form of a continuous flange or flange segments, extends substantially around a perimeter thereof, at least to one of the front side and the back side of the planar panel 44 adding rigidity to hook 30, neck region 32, and shoulder region 34 generally without adding unnecessary material or weight to primary hanger 12. In one example, perimeter flange 46 also extends inwardly from an outer perimeter of hook 30 to define a non-flanged portion 45 (generally indicated in FIG. 3) of hook 30 for receiving separate indicator 48, such as a size indicator, branding indicator, etc. A recess 50 is defined between perimeter flange 46 and a top panel 80 of the neck region 32 and shoulder region 34 on at least one side of planar panel 44, at least in one embodiment.

Each of the pair of arms 36 extends downwardly and outwardly away from shoulder region 34 in a symmetrical manner relative to one another to corresponding free arm ends 54. Each of pair of arms 36 intersects one another at an apex or vertex 52, which, in one example, is centered relative to shoulder region 34. In one embodiment, each of the pair of arms 36 extends away from shoulder region 34 with a substantially linear orientation and downward slope while, in other embodiments, each of the pair of arms 36 extends away from shoulder region 34 with a curved, horizontal, or otherwise sloped orientation. The pair of arms 36 are sized and shaped to support garments configured to be worn on the top of a body, in one embodiment.

As illustrated with primary reference to FIGS. 1, 2A, 2B, and 3, in one embodiment, the pair of arms 36 are formed via a pair of primary panels 60, for example, a front or first panel 62 and a rear or second panel 64. First panel 62 and second panel 64 are spaced from each other and parallel to one another, in one embodiment. First panel 62 and second panel 64 may have substantially identical overall shapes. First panel 62 defines an interior-facing surface, for example, a rear-facing surface 66, and an opposite an exterior-facing surface, for example, a front-facing surface 68, while second panel 64 defines an exterior-facing surface, for example, a rear-facing surface 70 and an interior-facing surface, e.g., a front-facing surface 72. In one embodiment, a single first panel 62 and a single second panel 64 extends from one free arm end 54 to the other while, in other embodiments, each arm 36 is formed of a separate pair of primary panels 60. In addition, while primarily described herein as primary hanger 12 including the pair of arms 36, in some embodiments, primary hanger 12 includes a single arm 36 or three or more arms 36.

In one example, a top panel 80 extends between top edges 82 and 84 of first panel 62 and second panel 64, respectively, to cap a top of the pair of arms 36. In one embodiment, pair of arms 36 is open below top panel 80, between rear-facing surface 66 of first panel 62 and front-facing surface 68 of second panel 64, more particularly, at bottom edges 86 and 88 of first panel 62 and second panel 64, respectively, forming an interior cavity 90.

Primary hanger 12 includes a coupling cavity 94 between rear-facing surface 66 of first panel 62 and front-facing surface 68 of second panel 64 and in a location generally aligned with vertex 52. In one embodiment, coupling cavity 94 is a small portion of interior cavity 90, while, in other embodiments, coupling cavity 94 is formed separately from interior cavity 90. Coupling cavity 94 is open to a bottom of primary hanger 12 adjacent bottom edges 86 and 88 to form opening 95. In one embodiment, coupling cavity 94 does not extend beyond a bottom edge of pair of arms 36 so as not to intrude upon the clean aesthetics of hanger 12. The boundaries of coupling cavity 94 between first panel 62 and second panel 64 are defined by interior side walls 92, in one example, each extending from rear-facing surface 66 of first panel 62 to front-facing surface 68 of second panel 64 on opposite sides of vertex 52. Interior side walls 92 are each spaced from each other to accommodate a first end 24 of coupling member 22, as will be further described below.

An aperture 98 is defined in second panel 64 extending from front-facing surface 68, that is, from coupling cavity 94 toward and, in one embodiment, through rear-facing surface 70 of second panel 64. Aperture 98 at least partially serves as a latch to secure coupling member 22 to primary hanger 12, as will be further described below.

Primary hanger 12, in one embodiment, additionally includes one or more, for example, two, vertical rails 96 extending from rear-facing surface 66 of first panel 62 toward, but not to second panel 64, that is, into coupling cavity 94. Rails 96 are configured to facilitating friction fit and/or proper workings of any latch between primary hanger 12 and coupling member 22. In one example, rails 96 extend along a substantially entirety of a height of coupling cavity 94, while, in another example, one or more of rails 96 only partiality extends along a height and/or intermittently extends along a height of coupling cavity 94.

Coupling member 22 is configured to be partially and selectively received within coupling cavity 94. In one embodiment, coupling member 22 includes a first clip 100, a second clip 102, and an elongated segment 104 extending between the first clip 100 and the second clip 102. First clip 100 is configured to fit substantially entirely within coupling cavity 94 to selectively secure coupling member 22 to primary hanger 12. Second clip 102 is configured to be selectively secured with any one of auxiliary hangers 16, 18, and 20, thereby securing primary hanger 12 to the one of auxiliary hangers 16, 18, and 20. First end 106 of elongated segment 104 is coupled to first clip 100 and an opposite, second end 108 of elongated segment 104 is coupled to second clip 102, such that elongated segment 104 spaces primary hanger 12 from the one of auxiliary hangers 16, 28, and 20 to provide desired clearance between the two to accommodate garment (not shown) being hung thereon and to space the garments from each other in a desired manner for visually presenting both garments to a potential consumer or other viewer of a hanger assembly, such as hanger assembly 28A among others.

In one example, first clip 100 has an overall substantially rectangular shape, however, other suitable shapes are apparent to those of skill in the art. First clip 100 includes a bottom wall 110, a top wall 112 opposite bottom wall 110, and opposing sidewalls 114 each extending between top wall 112 and bottom wall 110. Top wall 112 and bottom wall 110 are spaced a distance less than an overall height of coupling cavity 94, in one embodiment. In one example, sidewalls 114 each extend substantiality parallel to elongated segment 104 and are spaced apart from one another just slightly smaller than a width of coupling cavity 94. As formed, first clip 100 includes a first or front side 120 and a second or rear side 122 opposite front side 120.

First clip 100 includes a locking tab 116 formed in an interior of first clip 100, that is, between sidewalls 114 and between top wall 112 and bottom wall 110. In one example, locking tab 116 is partially separated from a remainder of first clip 100 by a U-shaped channel or U-shaped slit 118. In particular, as illustrated, U-shaped slit 118 extends downwardly into an interior of first clip 100 from just below top wall 112 and near one of sidewalls 114, toward bottom wall 110, turning to extend toward the opposite sidewall 114, and turning again to extend toward, and almost to, top wall 112. A flange 126 extends rearwardly along or near to a bottom-most edge of locking tab 116, more particularly, from rear side 122 of first clip 100. Flange 126 is sized and shaped to be snugly received in aperture 98 of primary hanger 12. First clip 100 is formed of a material and thickness that is substantially rigid, but still allows locking tab 116 to slightly move, more particularly, bend about rotation line 128, or a top boundary line thereof as generally indicated in FIGS. 5-8, as will be further described below. In one example, one or more indentations or recesses 130 are formed in first clip 100 to save in overall material needed to form first clip 100, but in a manner that does not substantially degrade the integrity of first clip 100 required to maintain a robust coupling with primary hanger 12, as will be further described below.

Elongated segment 104 extends from first clip 100 down to a second end 108 thereof that is coupled to second clip 102. Elongated segment 104 may be in any suitable form to provide strength for supporting one of auxiliary hangers 16, 18, and 20 and a garment or garments hung thereon from one of primary hangers 12 and 14. In one embodiment, second clip 102 is formed substantially identically to, but inverted from, first clip 100 as indicated by like reference numerals in the figures, see, e.g., FIGS. 5-12. In other embodiments, details of first clip 100 and second clip 102 may differ from each other as will be apparent to those of skill in the art upon reading this application.

Figure 14:
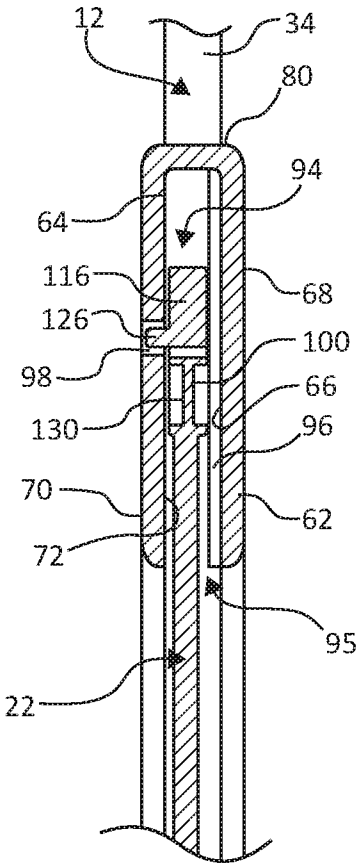
FIG. 14 is a cross-sectional view illustration taken about the line X-X in FIG. 2A, according to one embodiment of the present invention.
Figure 13:
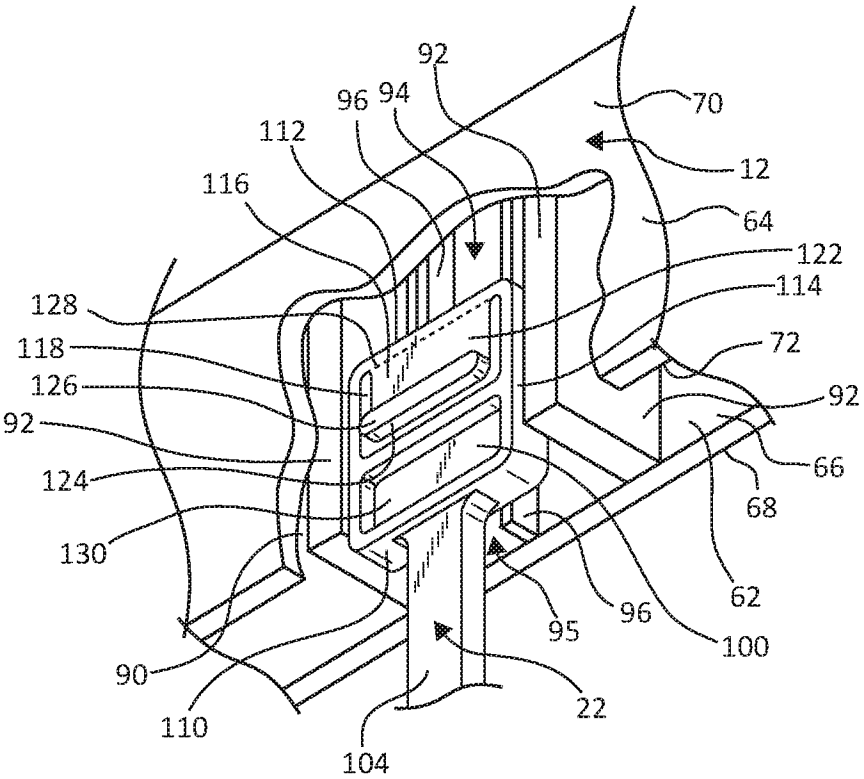
FIG. 13 is a detail view illustration of the coupling member of FIG. 5 interacting with the hanger of FIG. 3, according to one embodiment of the present invention.

Referring additionally to FIGS. 13 and 14, during use as part of a hanger assembly, such as hanger assembly 28A (see FIG. 2A), first clip 100 is received by and selectively coupled with coupling cavity 94 of primary hanger 12. More specifically, coupling member 22 is oriented so first clip 100 is on top and second clip 102 hangs substantially directly below first clip 100. First clip 100 is slid into coupling cavity 94 of primary hanger 12 via opening 95 thereto formed along bottom edges 86 and 88 of first panel 62 and second panel 64, respectively. When first clip 100 is so inserted in coupling cavity 94, sidewalls 114 are each positioned adjacent, and, in one example, in contact and to friction fit with and between interior side walls 92 of primary hanger 12 in coupling cavity 94. Sliding first clip 100 into coupling cavity 94 slides rear side 122 of first clip 100 along rails 96 in a manner tightly pushing first clip 100 toward second panel 64 of hanger to increase the compression fit therein.

In one example, while being pushed through coupling cavity 94, sufficient vertical force is applied to first clip 100 to cause locking tab 116 to bend slightly forwardly toward rails 96 along rotation line 128 to slide into coupling cavity 94. The rearward pressure from rails 96 on first clip 100 also causes locking tab 116 to rotate rearwardly pushing flange 126 back and partially through aperture 98 in second panel 64 of primary hanger 12 upon vertical alignment thereof, thereby, selectively locking first clip 100 within coupling cavity 94. In this manner, first clip 100 is held in place in coupling cavity 94 via friction/compression fit between interior side walls 92, between rails 96 and second panel 64, and/or by interaction between flange 126 and aperture 98 of second panel 64. In one example, rails 96 provide additional push on first clip 100 to push flange 126 into a more robust coupling in aperture 98 of second panel 64 while keeping overall material needs to form primary hanger 12 lower than a solid, planar interaction with first clip 100. Rails 96 also have give allowing flange 126 to bend slightly toward front panel 62 during insertion into coupling cavity 94 so that flange 126 can clear a lower portion of coupling cavity 94 before nesting in aperture 98.

Figure 15:
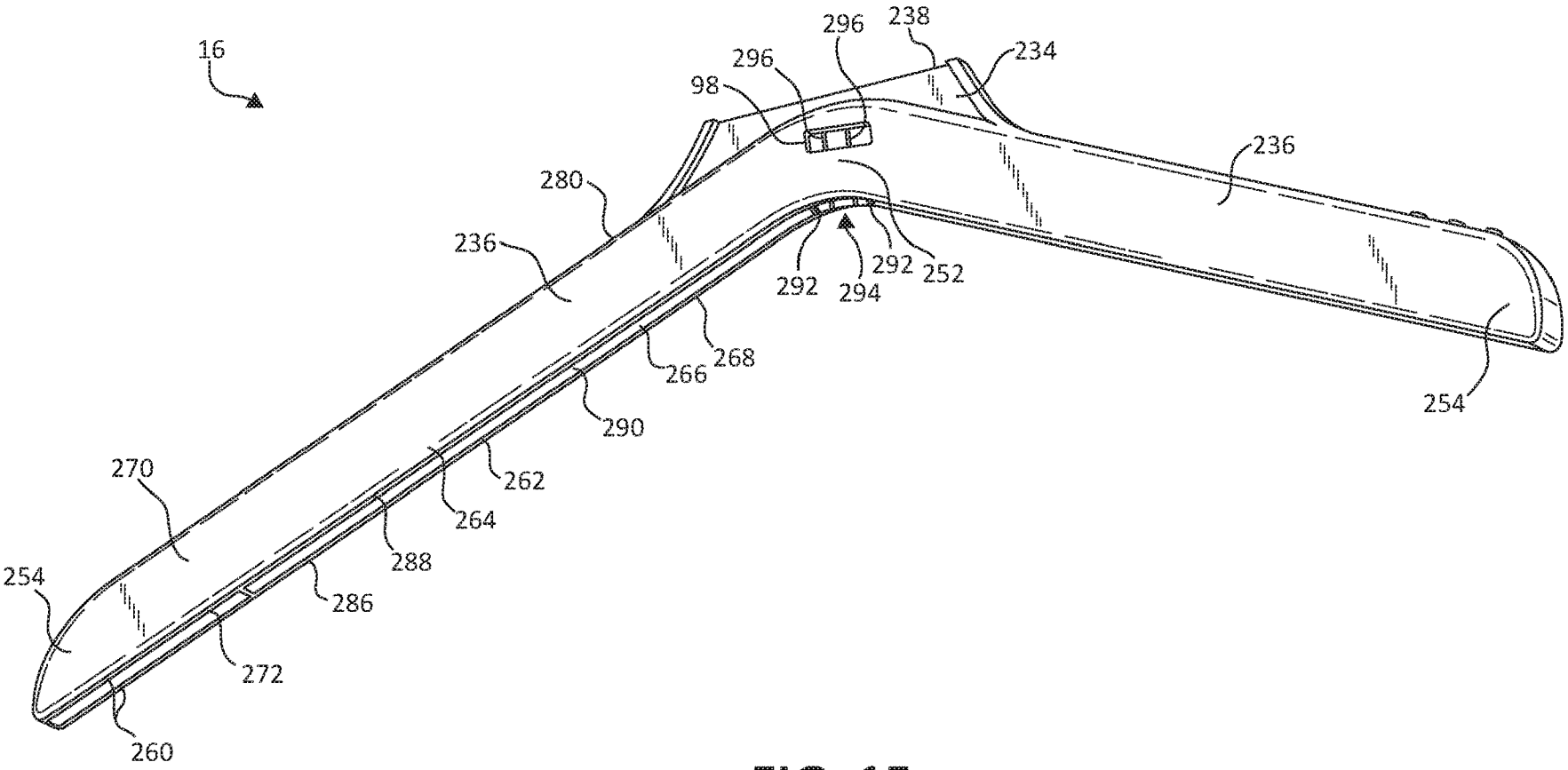
FIG. 15 is a rear perspective view illustration of one auxiliary hanger of the hanger system of FIG. 1, according to one embodiment of the present invention.

Auxiliary hanger 16, in one embodiment, is substantially similar to primary hanger 12, but does not include hook 30, neck region 32, and/or shoulder region 34. More specifically, in one embodiment, as illustrated in FIGS. 1, 2, and 15, auxiliary hanger 16 includes a shoulder region 234 and a pair of arms 236. Shoulder region 234 is truncated as compared to shoulder region 34 of primary hanger 12 and defines a topmost edge 238 rather than transitioning to a hook 30 like primary hanger 12. Each of the pair of arms 236 extends downwardly and outwardly away from a shoulder region 34, more particularly, from an apex or vertex 52 just below shoulder region 34, in a symmetrical manner relative to one another to corresponding free arm ends 254. In one embodiment, each of the pair of arms 236 extends away from shoulder region 234 with a substantially linear orientation while, in other embodiments, each of the pair of arms 236 extends away from shoulder region 234 with a curved or otherwise sloped orientation. The pair of arms 236 are sized and shaped to support garments configured to be worn on the top of a body, in one embodiment. In one embodiment, the pair of arms 236 of auxiliary hanger 16 are sized and shaped substantially identically to pair of arms 36 of primary hanger 12; while in other embodiments, the pair of arms 236 of auxiliary hanger 16 are sized or shaped differently than the pair of arms 36 of primary hanger 12.

As illustrated with primary reference to FIG. 15, in one embodiment, the pair or arms 236 is formed via a pair of primary panels 260, for example, a front or first panel 262 and a rear or second panel 264. First panel 262 and second panel 264 are spaced from each other and parallel to one another, in one embodiment. First panel 262 and second panel 64 may have substantially identical overall shapes. First panel 262 defines an interior-facing surface, for example, a rear-facing surface 266, and an opposite an exterior-facing surface, for example, a front-facing surface 268, while second panel 64 defines an exterior-facing surface, for example, a rear-facing surface 270 and an interior-facing surface, e.g., a front-facing surface 272. In one embodiment, a single first panel 262 and a single second panel 264 extends from one free arm end 254 to the other, while, in other embodiments, each arm 236 is formed of a separate pair of primary panels 60. In addition, while primarily described herein as auxiliary hanger 16 including the pair of arms 236, in some embodiments, auxiliary hanger 16 includes a single arm 236 or three or more arms 236.

In one example, a top panel 280 extends on top of and between first panel 262 and second panel 264, respectively, to cap a top of the pair of arms 236. In one embodiment, pair of arms 236 is open below top panel 280, between rear-facing surface 266 of first panel 262 and front-facing surface 268 of second panel 264, more particularly, at bottom edges 286 and 288 of first panel 2262 and second panel 64, respectively, forming an interior cavity 290.

Figure 16:
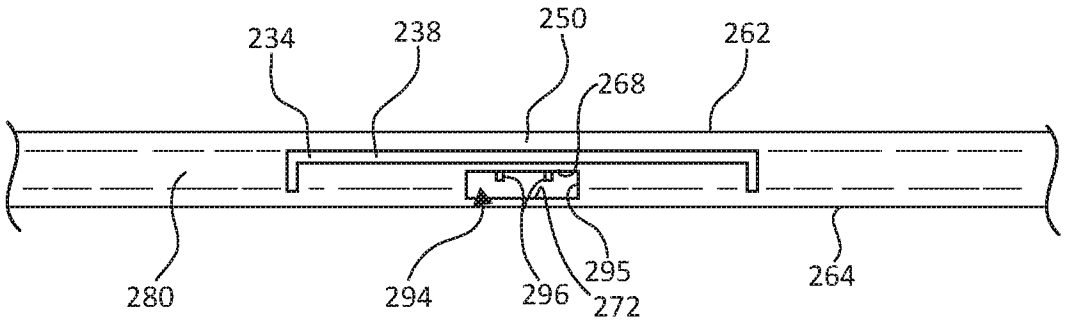
FIG. 16 is a partial top view illustration of the hanger of FIG. 15, according to one embodiment of the present invention.

With additional reference to FIG. 16, auxiliary hanger 16 includes a coupling cavity 294 between rear-facing surface 266 of first panel 262 and front-facing surface 268 of second panel 264 and in a location generally aligned with vertex 52. In one embodiment, coupling cavity 294 is formed substantially identically to coupling cavity 94 only with an inverted orientation including an opening to an opposite side of the respective coupling cavity 294 and 94 configured to receive second clip 102 of coupling member 22 (see, e.g., FIGS. 1-2C and 5-12). Coupling cavity 294 is a small portion of interior cavity 290, in one embodiment, while, in other embodiments, coupling cavity 294 is formed separately from interior cavity 290. Coupling cavity 294 is open to a bottom of auxiliary hanger 16 adjacent bottom edges 286 and 288 to form opening 295. The boundaries of coupling cavity 294 between first panel 262 and second panel 264 are defined by interior side walls 292, in one example, each extend from rear-facing surface 266 of first panel 262 to front-facing surface 268 of second panel 264 on opposite sides of vertex 252. Interior side walls 292 are each spaced from each other to accommodate second clip 102 of coupling member 22, as will be further described below.

An opening 98 is defined in second panel 264 extending from front-facing surface 268, that is, from coupling cavity 294 toward and, in one embodiment, through rear-facing surface 270 of second panel 64. Opening 98 at least partially serves as a latch to secure coupling member 22 to auxiliary hanger 16, that is second clip 102 of coupling member 22, as will be further described below.

Auxiliary hanger 16, in one embodiment, additionally includes one or more, for example, two, vertical rails 296 extending from rear-facing surface 266 of first panel 262 toward, but not to second panel 264, that is, into coupling cavity 294. Rails 296 are configured to facilitate friction fit and/or proper workings of any latch between auxiliary hanger 16 and coupling member 22. In one example, rails 296 extend along a substantial entirety of a height of coupling cavity 294, while, in another example, one or more of rails 296 only partiality extends along a height and/or intermittently extends along a height of coupling cavity 294.

Figure 2A:
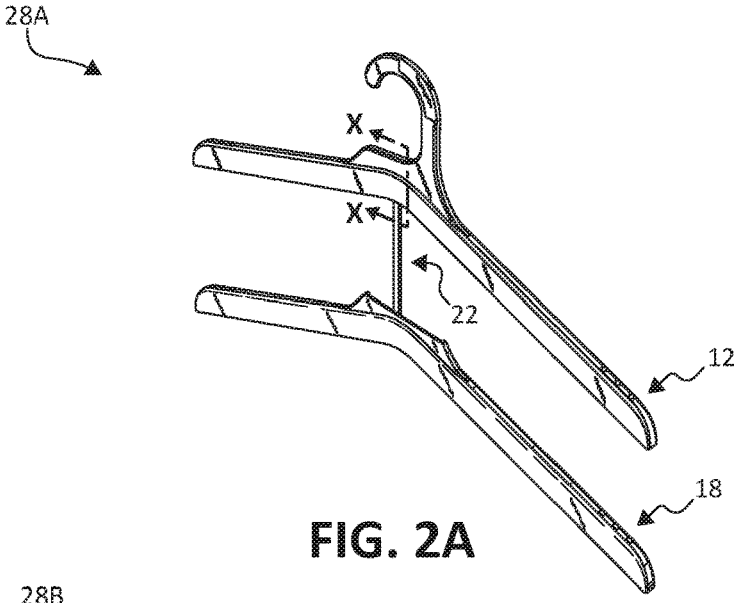
FIGS. 2A-2C are each a front perspective view illustration of different hanger assembly formed using ones of the hangers from the hanger system of FIG. 1, according to one embodiment of the present invention.

To form a hanger assembly, such as hanger assembly 28A show in FIG. 2A, second clip 102 of coupling member 2 is slid through opening 295 into coupling aperture 98 of auxiliary hanger 16 in a manner substantially identical to that described with respect to moving first clip 100 of coupling member 22 through opening 95 into coupling cavity 94 of primary hanger 12 except with inverted orientation and movement, as will be apparent to those of skill in the art upon reading this application. In one example, the similarities between coupling cavity 94 of primary hanger 12 and the coupling aperture 98 of auxiliary hanger 16 allow coupling member 22 to be used as described and/or in an inverted orientation with second clip 102 being received within coupling cavity 94 of primary hanger 12, and first clip 100 being received within coupling aperture 98 of auxiliary hanger 16. The resulting hanger assembly 28A, in one embodiment, is configured to hold two garments (not shown) configured to be worn on a torso of a wearer, with one garment being supported by each of primary hanger 12 and auxiliary hanger 16.

Figure 17:
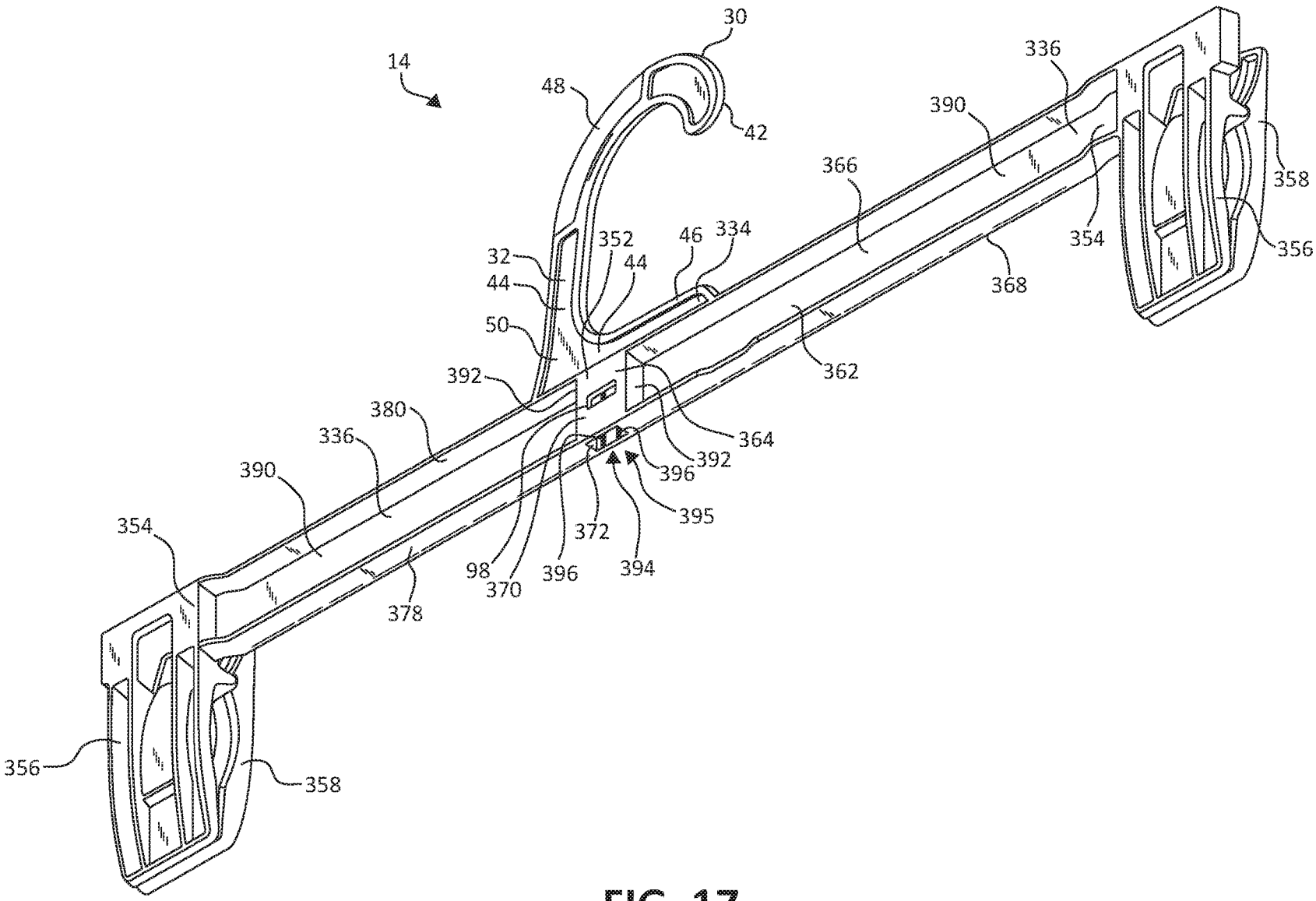
FIG. 17 is a rear perspective view illustration of one primary hanger of the hanger system of FIG. 1, according to one embodiment of the present invention.

As described with respect to FIG. 1, hanger system 10 is configured to be have various hangers couplable via coupling member 22. In that manner, one example of a primary hanger 14 that differs from primary hanger 12 is illustrated in FIG. 17. Like primary hanger 12, primary hanger 14 includes hook 30, neck region 32, a shoulder region 334, and a pair of arms 336, according to one embodiment of the present invention, with like reference numerals indicating like parts. Neck region 32 extends downwardly from hook 30 to a shoulder region 334, which is similar in function to shoulder region 34, but with a slightly different shape to provide desired rotation of primary hanger 14 on a support bar (not shown), desired aesthetics, and desired strength to primary hanger 14. In one example, hook 30, neck region 32, and shoulder region 34 are collectively formed of a primary, planar panel 344. Perimeter flange 346, in the form of a continuous flange or flange segments, extends substantially around a perimeter thereof, at least to one of the front side and the back side of the planar panel 344 adding rigidity to hook 30, neck region 32, and shoulder region 334 generally without adding unnecessary material or weight to primary hanger 14. In one example, perimeter flange 46 also extends inwardly from an outer perimeter of hook 30 to define a non-flanged portion 344 of hook 30 for receiving separate indicator 48, such as a size indicator, branding indicator, etc. A recess 350 is defined between perimeter flange 46 and a top panel 80 of the neck region 32 and shoulder region 332 on at least one side of planar panel 344, at least in one embodiment.

Each of the pair of arms 336 extends outwardly away from shoulder region 334 in a symmetrical manner relative to one another to corresponding free arm ends 354. In one example, each of pair of arms 336 intersects one another at an apex or vertex 352, which, in one example, is centered relative to shoulder region 334. In one embodiment, each of the pair of arms 336 extends away from shoulder region 34 with a substantially linear orientation, for example, with a substantially horizontal orientation while, in other embodiments, each of the pair of arms 36 extends away from shoulder region 34 with a curved or otherwise sloped orientation. In one example, each of pair of arms 336 are substantially colinear in their extension away from vertex 352.

In one example, primary hanger 14 defines a first clamp portion 356 at each of free arm ends 354 that depend downwardly, upwardly, or both downwardly and upwardly from a remainder of each of the pair of arms 336. Primary hanger 14 additionally includes a second clamp portion 358 formed separately from first clamp portion 356. Each second clamp portion 358 is rotatably coupled with and biased toward first clamp portion 358 to collectively form a clamp at each of free arm ends 354 to clamp onto a garment (not shown), such a garment configured to be worn over the legs of a wearer or other suitable garment benefitting from clamping securement to primary hanger 14. In one embodiment, clamps of primary hanger 14 are eliminated and/or replaced with clips, other clamps, or other securement mechanisms as will be apparent to those of skill in the art upon reading the current application.

Figure 2B:
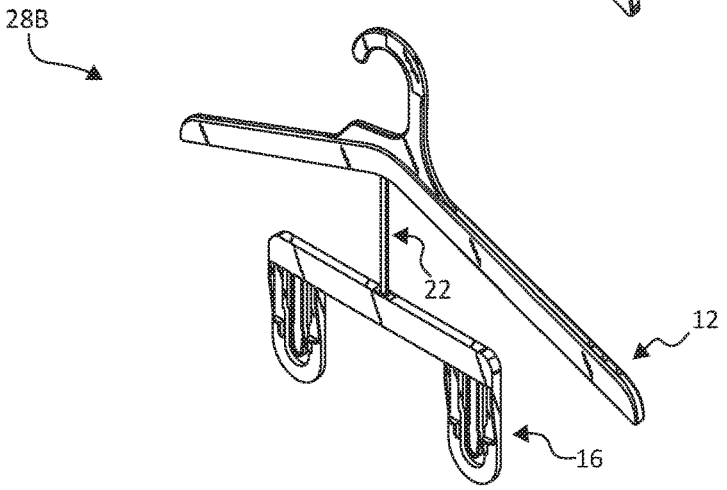
Figure 2C:
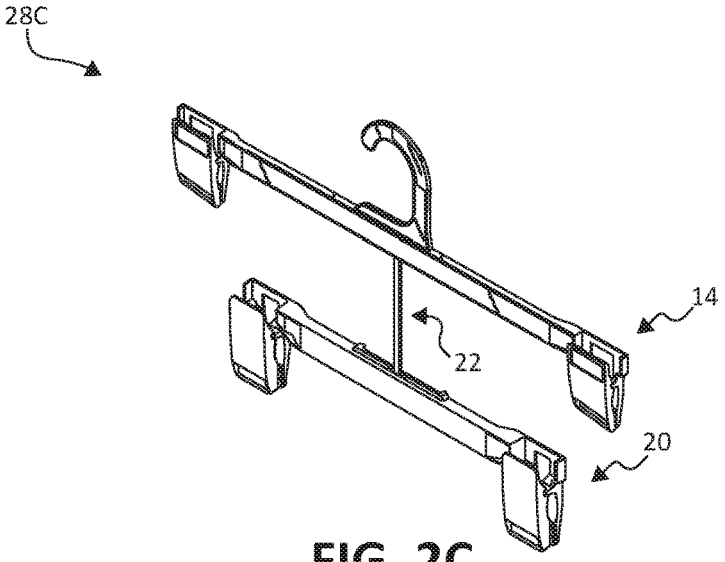

As illustrated with primary reference to FIGS. 1, 2C, and 17, in one embodiment, the pair or arms 336 are formed via a first panel 362 having a rear-facing surface 366, and an opposite an exterior-facing surface, for example, a front-facing surface 368. While primarily described herein as primary hanger 14 including the pair of arms 336, in some embodiments, primary hanger 14 includes a single arm 336 or three or more arms 336.

In one example, a top panel 380 extends rearwardly from a top of first panel 362, and bottom panel 378 extends rearwardly from a bottom of top panel 380 in a manner substantially parallel to top panel 380. In one embodiment, pair of arms 336 is open between bottom panel 378 and top panel 380, behind rear-facing surface 366 of first panel 362 forming an interior cavity 390. In one example, primary hanger 14 includes a second panel 364 formed on an opposite side of interior cavity 390 as compared to first panel 362. While, in one embodiment, second panel 364 is coextensive with first panel 362, in one example, as illustrated in FIG. 17, second panel 364 is considerably smaller than first panel 362. Second panel 364 defines an exterior-facing surface, for example, a rear-facing surface 370 and an interior-facing surface, e.g., a front-facing surface 372.

Primary hanger 14 includes a coupling cavity 394 between rear-facing surface 366 of first panel 362 and front-facing surface 368 of second panel 364 and in a location generally aligned with vertex 352. In one embodiment, coupling cavity 394 is a small portion of interior cavity 390 while, in other embodiments, coupling cavity 394 is formed separately from interior cavity 390. Coupling cavity 394 is open to a bottom of primary hanger 14 through bottom panel 378 to form opening 395. The boundaries of coupling cavity 394 between first panel 362 and second panel 364 are defined by interior side walls 392 (generally indicated in FIG. 17), in one example, each extending from rear-facing surface 366 of first panel 362 to front-facing surface 368 of second panel 364 on opposite sides of vertex 352. Interior side walls 392 are each spaced from each other to accommodate first clip 100 of coupling member 22 in a manner substantially identical to how interior side walls 92 of primary hanger 12 are spaced from each other to accommodate first clip 100 of coupling member 22 as described above.

An aperture 98 is defined in second panel 364 extending from front-facing surface 368, that is, from coupling cavity 394 toward and, in one embodiment, through rear-facing surface 370 of second panel 364. Aperture 98 at least partially serves as a latch to secure coupling member 22 to primary hanger 14, as will be further described below.

Primary hanger 14, in one embodiment, additionally includes one or more, for example, two, vertical rails 396 extending from rear-facing surface 366 of first panel 62 toward, but not to second panel 364, that is, into coupling cavity 394. Rails 396 formed substantially identically to rails 96 of primary hanger 12 and are configured to facilitate friction fit and/or proper workings of any latch between primary hanger 14 and coupling member 22 just as rails 96 are configured to facilitate friction fit and/or proper workings of any latch between primary hanger 12 and coupling member 22. In one example, rails 396 extend along a substantially entirety of a height of coupling cavity 394, while in another example, one or more of rails 396 only partiality extends along a height and/or intermittently extends along a height of coupling cavity 394.

As described above, coupling cavity 394, opening 395, rails 396, and aperture 98 of primary hanger 14 are formed to be collectively nearly identical to and/or at least to function similarly with respect to first clip 100 as coupling cavity 94, opening 95, rails 96 and aperture 98 of primary hanger 12. In this manner, a single coupling member 22 can have first clip 100, or second clip 102, secured into either primary hanger 12 or primary hanger 14 as desired by one constructing hanger assembly 28A, 28B, 28C, or other hanger assembly (not shown).

Figure 18:
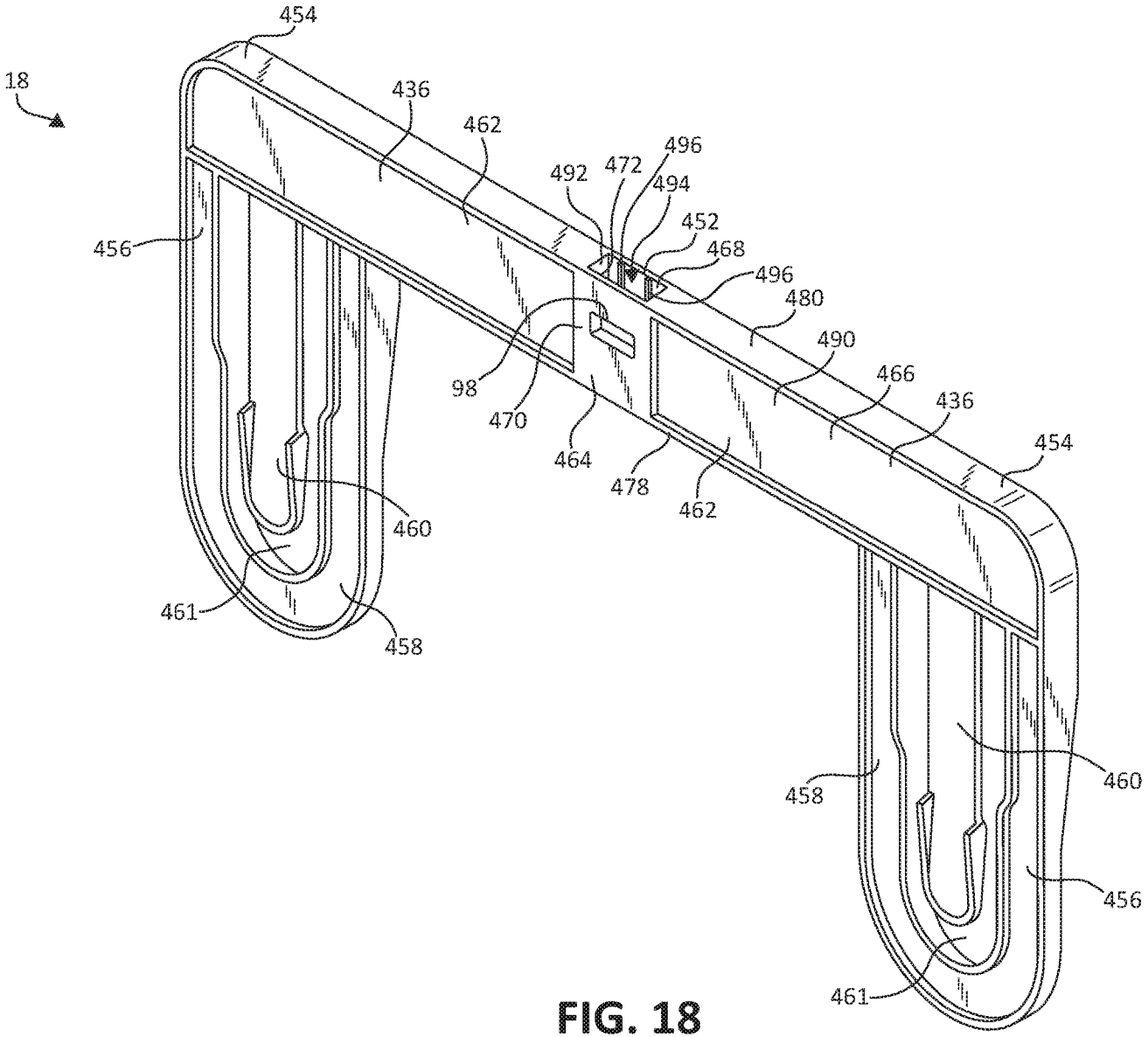
FIG. 18 is a rear perspective view illustration of one auxiliary hanger of the hanger system of FIG. 1, according to one embodiment of the present invention.

Auxiliary hanger 18, in one embodiment, like auxiliary hanger 16, does not include hook 30, neck region 32, and/or shoulder region 34 like primary hanger 12. More specifically, in one embodiment, as illustrated in FIGS. 1, 2B, and 18, auxiliary hanger 18 includes a pair of arms 436. Each of the pair of arms 436 extends outwardly away from a center or vertex 352 thereof in a symmetrical manner relative to one another to corresponding free arm ends 454. In one embodiment, each of the pair of arms 436 extends away from vertex 352 with a substantially linear orientation, for example, with a substantially horizontal orientation while, in other embodiments, each of the pair of arms 436 extends away from shoulder region 434 with a curved or otherwise sloped orientation. In one example, each of pair of arms 436 are substantially colinear in their extension away from vertex 452.

In one example, auxiliary hanger 18 defines a clip 456 at each of free arm ends 454 that depends downwardly, upwardly, or both downwardly and upwardly from a remainder of each of the pair of arms 436. In one embodiment, each clip 456 includes a substantially U-shaped member 458 and a finger member 460. U-shaped member 458 may be of any desired shape that begins at one of free arm ends 454, extends downwardly and inwardly, and then extends back to a more interior location on the respective one of the pair of arms 436. Finger member 460 extends from the respective one of the pair or arms 436 forming the corresponding U-shaped member 458 between the two intersections between the one of the pair of arms 435 and the corresponding U-shaped member 458. Each finger member 460, and in one embodiment, each U-shaped member 458, is slightly flexible to bend in at least one of a forward and a rearward direction to accommodate receiving a garment (not shown) between U-shaped member 458 and finger member 460, as will be understood by those of skill in the art upon reading this application. In one embodiment, clips 456 of auxiliary hanger 18 are eliminated and/or replaced with other clips, clamps, or other securement mechanisms, as will be apparent to those of skill in the art upon reading the currently application.

As illustrated with primary reference to FIGS. 1, 2C, and 18, in one embodiment, the pair or arms 436 are formed via a first panel 462 having a rear-facing surface 466, and an opposite an exterior-facing surface, for example, a front-facing surface 468. While primarily described herein as auxiliary hanger 18 including the pair of arms 436, in some embodiments, auxiliary hanger 18 includes a single arm 436 or three or more arms 436.

In one example, a top panel 480 extends rearwardly and/or forwardly from a top of first panel 462 and bottom panel 478 extends rearwardly and/or forwardly from a bottom of top panel 480 in a manner substantially parallel to top panel 480. In one embodiment, pair of arms 436 is open between bottom panel 478 and top panel 480, behind rear-facing surface 466 of first panel 462 forming an interior cavity 490. In one example, auxiliary hanger 18 includes a second panel 464 formed on an opposite side of interior cavity 490 as compared to first panel 462. While, in one embodiment, second panel 464 is coextensive with first panel 462, in one example, as illustrated in FIG. 18, second panel 464 is considerably smaller than first panel 462. Second panel 464 defines an exterior-facing surface, for example, a rear-facing surface 470 and an interior-facing surface, e.g., a front-facing surface 472.

Auxiliary hanger 18 includes a coupling cavity 494 between rear-facing surface 466 of first panel 462 and front-facing surface 468 of second panel 464 and in a location generally aligned with vertex 452. In one embodiment, coupling cavity 494 is a small portion of interior cavity 490 while, in other embodiments, coupling cavity 494 is formed separately from interior cavity 490. Coupling cavity 494 is open to a top of auxiliary hanger 18 through top panel 480 to form opening 495. The boundaries of coupling cavity 494 between first panel 462 and second panel 464 are defined by interior side walls 492 (generally indicated in FIG. 18), in one example, each extending from rear-facing surface 466 of first panel 462 to front-facing surface 468 of second panel 464 on opposite sides of vertex 452. Interior side walls 492 of auxiliary hanger 18 are each spaced from each other to accommodate second clip 102, or, in one example, first clip 100, of coupling member 22 in a manner substantially identical to how interior side walls 292 of auxiliary hanger 16 are spaced from each other to accommodate second clip 102, or first clip 100, of coupling member 22 as described above.

An aperture 98 is defined in second panel 464 extending from front-facing surface 468, that is, from coupling cavity 494 toward and, in one embodiment, through rear-facing surface 470 of second panel 464. Aperture 98 at least partially serves as a latch to secure coupling member 22 to auxiliary hanger 18 in a similar manner as described with respect to auxiliary hanger 16 above.

Auxiliary hanger 18, in one embodiment, additionally includes one or more, for example, two, vertical rails 496 extending from rear-facing surface 466 of first panel 462 toward, but not to second panel 464, that is, into coupling cavity 494. Rails 496 are formed substantially identically to rails 96 of primary hanger 12 and are configured to facilitate friction fit and/or proper workings of any latch between auxiliary hanger 18 and coupling member 22 just as rails 96 are configured to facilitate friction fit and/or proper workings of any latch between primary hanger 12 and coupling member 22. In one example, rails 496 extend along a substantially entirety of a height of coupling cavity 494, while in another example, one or more of rails 496 only partiality extends along a height and/or intermittently extends along a height of coupling cavity 494.

As described above, coupling cavity 494, opening 495, rails 496, and aperture 98 of auxiliary hanger 18 are formed to be collectively nearly identical to and/or at least to function similarly with respect to first clip 100, or second clip 102, as coupling cavity 294, opening 295, rails 296 and aperture 98 of auxiliary hanger 16.

Figure 19:
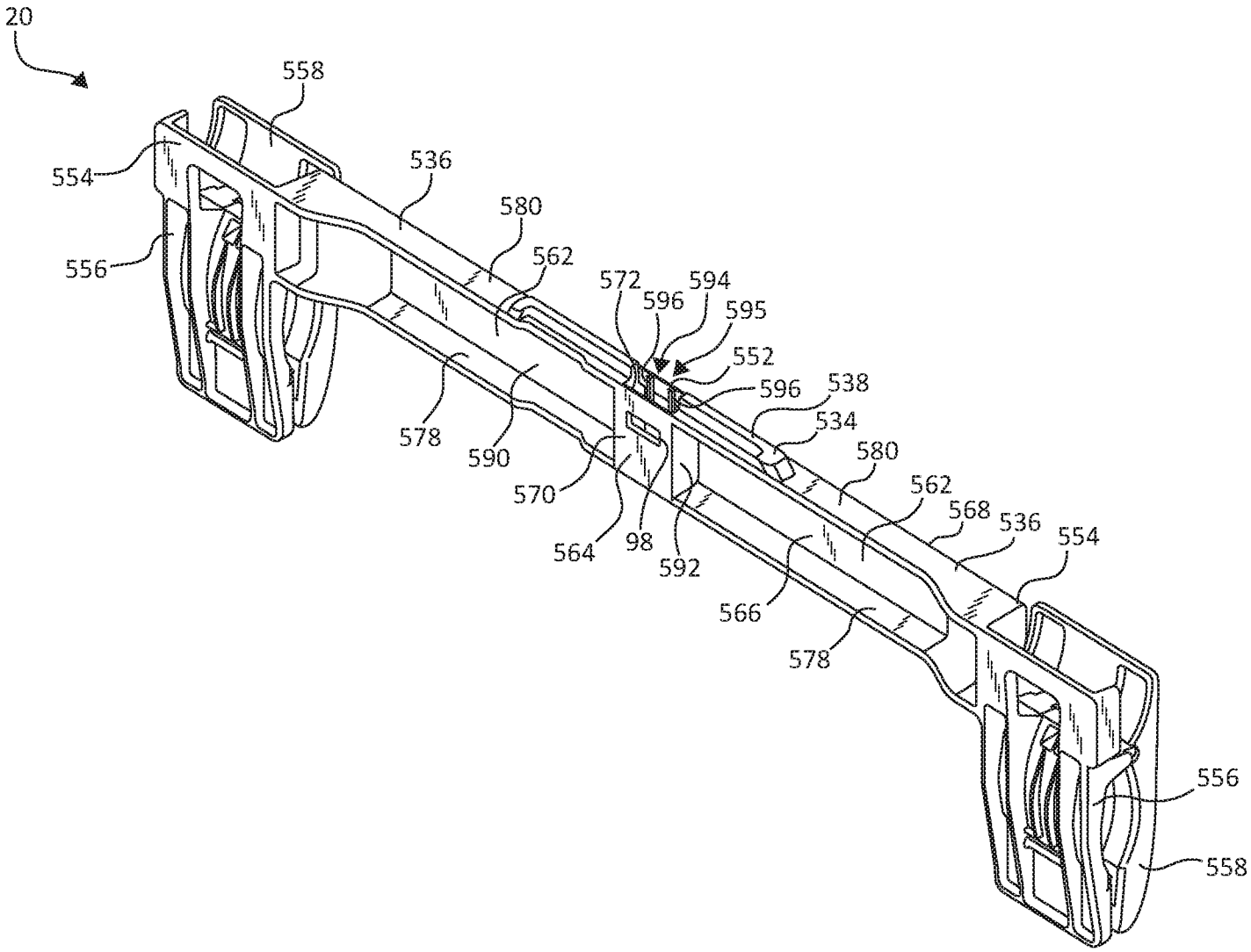
FIG. 19 is a rear perspective view illustration of one auxiliary hanger of the hanger system of FIG. 1, according to one embodiment of the present invention.

Auxiliary hanger 20, in one embodiment, is substantially similar to primary hanger 14, but does not include hook 30, neck region 32, and/or shoulder region 334. More specifically, in one embodiment, as illustrated in FIGS. 1, 2C, and 19, auxiliary hanger 20 includes a shoulder region 534 and a pair of arms 536. Shoulder region 534 is truncated as compared to shoulder region 334 of primary hanger 14 and defines a top most edge 538 rather than transitioning to hook 30 like primary hanger 14.

Each of the pair of arms 536 extends outwardly away from shoulder region 534 in a symmetrical manner relative to one another to corresponding free arm ends 554. In one example, each of pair of arms 536 intersects one another at an apex or vertex 552, which, in one example, is centered relative to shoulder region 534. In one embodiment, each of the pair of arms 536 extends away from shoulder region 534 with a substantially linear orientation, for example, with a substantially horizontal orientation while, in other embodiments, each of the pair of arms 536 extends away from shoulder region 534 with a curved or otherwise sloped orientation. In one example, each of pair of arms 536 are substantially colinear in their extension away from vertex 552.

In one example, auxiliary hanger 20 defines a first clamp portion 556 at each of free arm ends 554 that depends downwardly, upwardly, or both downwardly and upwardly from a remainder of each of the pair of arms 536. Auxiliary hanger 20 additionally includes a second clamp portion 558 formed separately from first clamp portion 556. Each second clamp portion 358 is rotatably coupled with and biased toward first clamp portion 556 to collectively form a clamp at each of free arm ends 554 to clamp onto a garment (not shown), such a garment configured to be worn over the legs of a wearer or other suitable garment benefitting from clamping securement to auxiliary hanger 20. In one embodiment, clamps of auxiliary hanger 20 are eliminated and/or replaced with clips, other clamps, or other securement mechanisms as will be apparent to those of skill in the art upon reading the current application.

As illustrated with primary reference to FIGS. 1, 2C, and 19, in one embodiment, the pair or arms 536 are formed via a first panel 562 having a rear-facing surface 566, and an opposite an exterior-facing surface, for example, a front-facing surface 568. While primarily described herein as auxiliary hanger 20 including the pair of arms 536, in some embodiments, auxiliary hanger 20 includes a single arm 536 or three or more arms 536.

In one example, a top panel 580 extends rearwardly from a top of first panel 562 and bottom panel 578 extends rearwardly from a bottom of top panel 580 in a manner substantially parallel to top panel 380. In one embodiment, pair of arms 536 is open between bottom panel 578 and top panel 580, behind rear-facing surface 566 of first panel 362 forming an interior cavity 590. In one example, auxiliary hanger 20 includes a second panel 564 formed on an opposite side of interior cavity 590 as compared to first panel 562. While, in one embodiment, second panel 564 is coextensive with first panel 562, in one example, as illustrated in FIG. 19, second panel 564 is considerably smaller than first panel 562. Second panel 564 defines an exterior-facing surface, for example, a rear-facing surface 570 and an interior-facing surface, e.g., a front-facing surface 572.

Auxiliary hanger 20 includes a coupling cavity 594 between rear-facing surface 566 of first panel 562 and front-facing surface 568 of second panel 564 and in a location generally aligned with vertex 552. In one embodiment, coupling cavity 594 is a small portion of interior cavity 590 while, in other embodiments, coupling cavity 594 is formed separately from interior cavity 590. Coupling cavity 594 is open to a top of auxiliary hanger 20 through top panel 580 to form opening 595. The boundaries of coupling cavity 594 between first panel 562 and second panel 564 are defined by interior side walls 592 (generally indicated in FIG. 19), in one example, each extend from rear-facing surface 566 of first panel 562 to front-facing surface 568 of second panel 564 on opposite sides of vertex 552. Interior side walls 592 are each spaced from each other to accommodate second clip 102, or, in one example, first clip 100, of coupling member 22 in a manner substantially identical to how interior side walls 92 of primary hanger 12 are spaced from each other to accommodate first clip 100 of coupling member 22 as described above.

An aperture 98 is defined in second panel 564 extending from front-facing surface 568, that is, from coupling cavity 594 toward and, in one embodiment, through rear-facing surface 570 of second panel 564. Aperture 98 at least partially serves as a latch to secure coupling member 22 to auxiliary hanger 20 in a similar manner as described with respect to auxiliary hanger 16 and 18 above.

Auxiliary hanger 20, in one embodiment, additionally includes one or more, for example, two, vertical rails 596 extending from rear-facing surface 566 of first panel 562 toward, but not to second panel 564, that is, into coupling cavity 594. Rails 596 are formed substantially identically to rails 96 of primary hanger 12 and are configured to facilitate friction fit and/or proper workings of any latch between auxiliary hanger 20 and coupling member 22 just as rails 96 are configured to facilitate friction fit and/or proper workings of any latch between primary hanger 12 and coupling member 22. In one example, rails 596 extend along a substantially entirety of a height of coupling cavity 594, while in another example, one or more of rails 596 only partiality extends along a height and/or intermittently extends along a height of coupling cavity 594.

As described above, coupling cavity 594, opening 595, rails 596, and aperture 98 of auxiliary hanger 20 are formed to be collectively nearly identical to and/or at least to function similarly with respect to first clip 100 as coupling cavity 294, opening 295, rails 296 and aperture 98 of auxiliary hanger 16. In this manner, a single coupling member 22 can have first clip 100, or second clip 102, secured into either auxiliary hanger 16, auxiliary hanger 18, or auxiliary hanger 20 as desired by one constructing hanger assembly 28A, 28B, 28C, or other hanger assembly (not shown).

Figure 20:
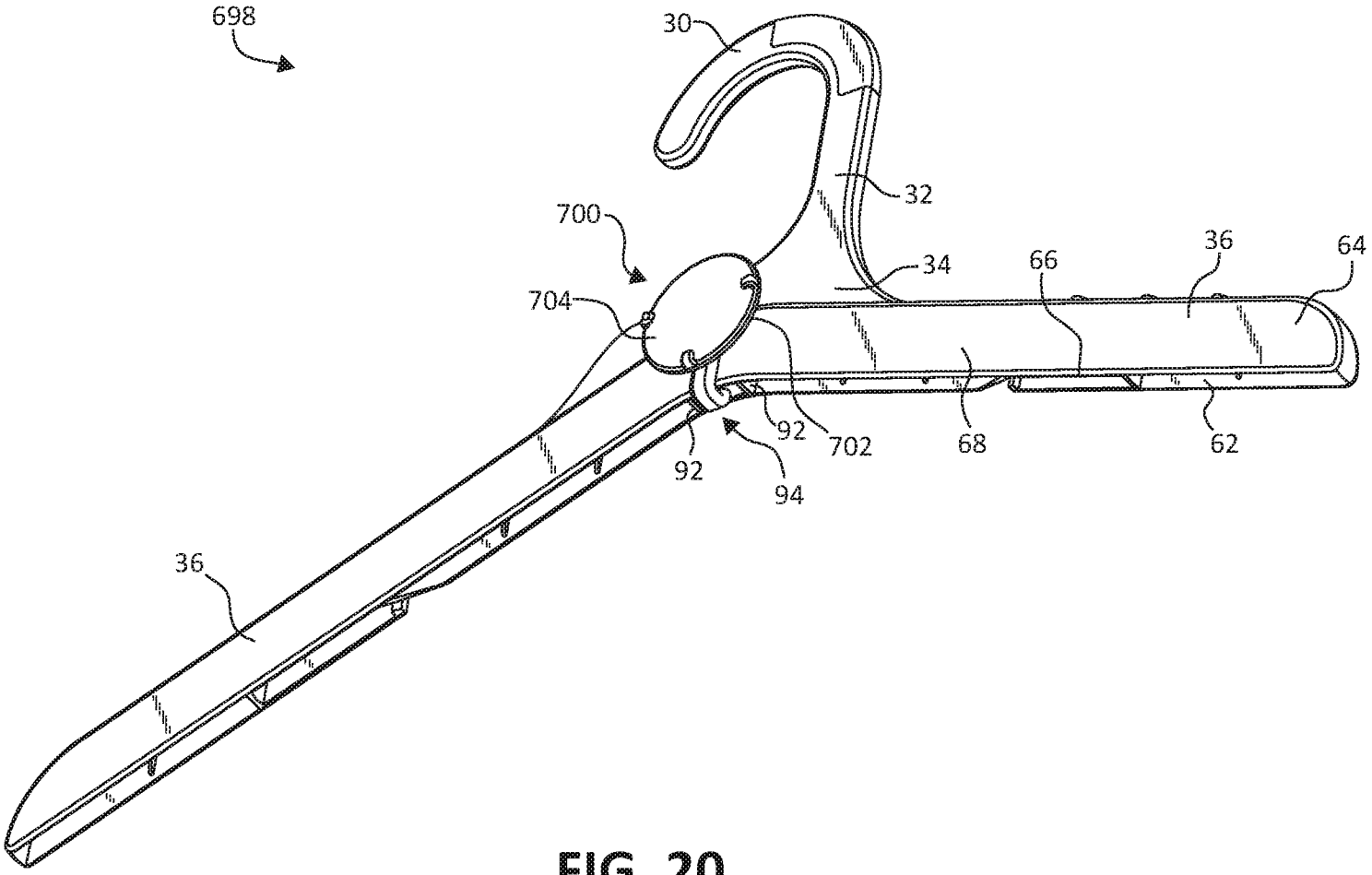
FIG. 20 is a bottom, front perspective view illustration of a hanger assembly including the primary hanger of FIG. 3 and an auxiliary identifier, according to one embodiment of the present invention.
Figure 22:
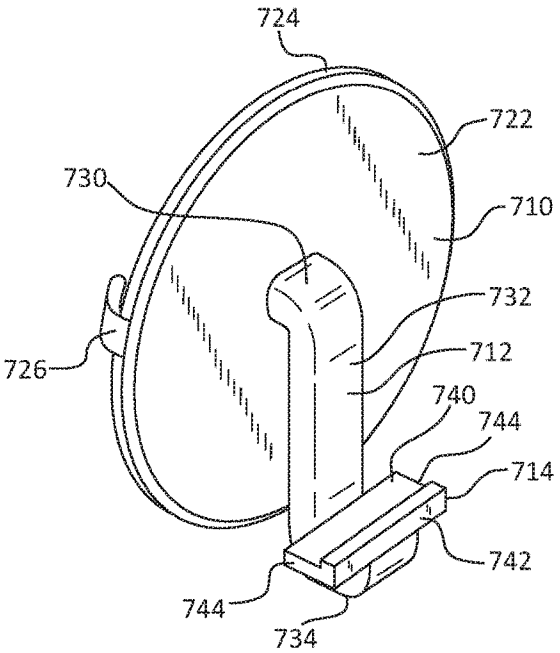
FIG. 22 is a rear perspective view illustration of the auxiliary identifier of FIG. 21, according to one embodiment of the present invention.
Figure 21:
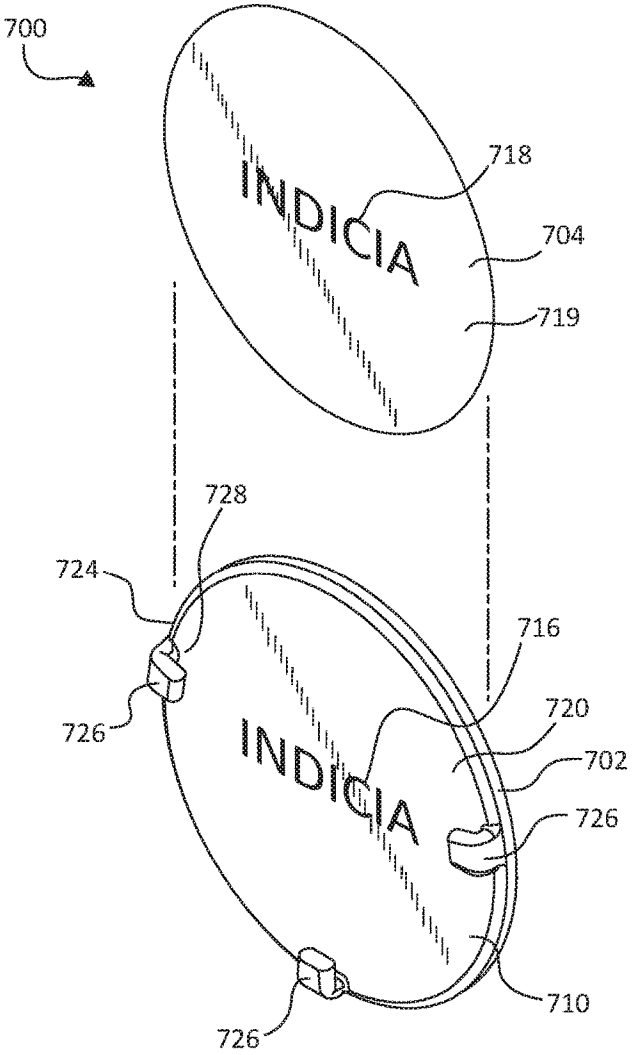
FIG. 21 is an exploded, front perspective view illustration the auxiliary identifier of FIG. 20 and a removable media member, according to one embodiment of the present invention.
Figure 24:
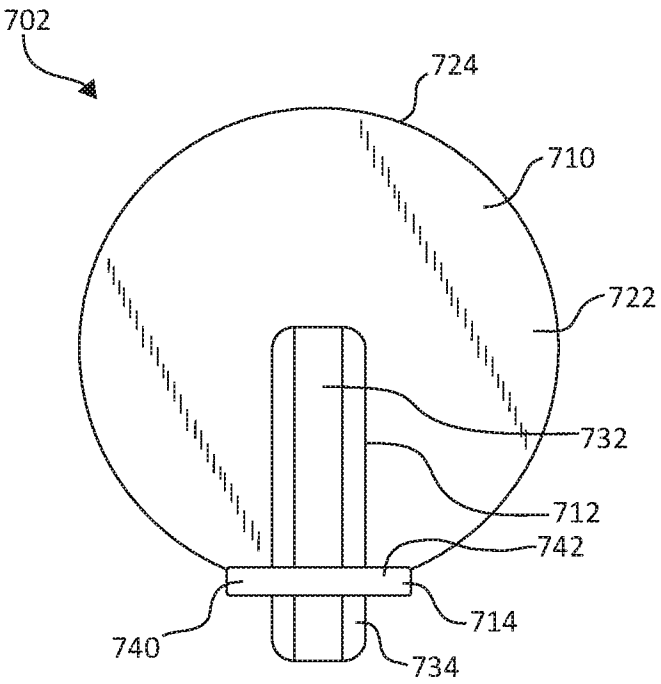
FIG. 24 is a rear view illustration of the auxiliary identifier of FIG. 21, according to one embodiment of the present invention.
Figure 23:
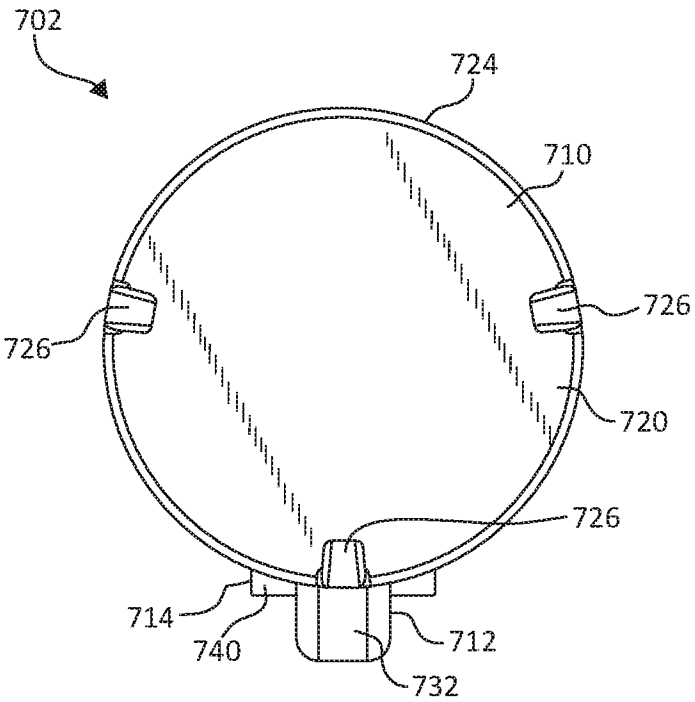
FIG. 23 is a front view illustration of the auxiliary identifier of FIG. 21, according to one embodiment of the present invention.
Figure 27:
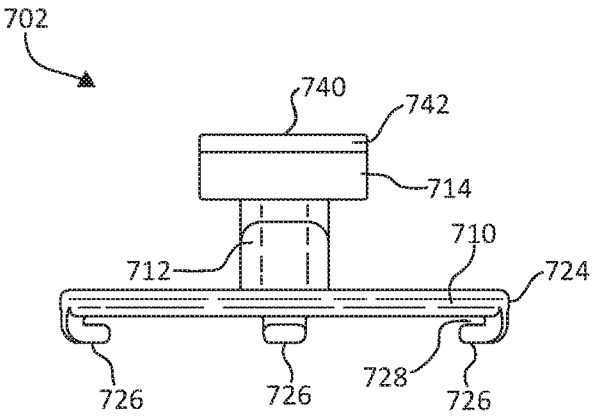
FIG. 27 is a bottom view illustration of the auxiliary identifier of FIG. 21, according to one embodiment of the present invention.
Figure 26:
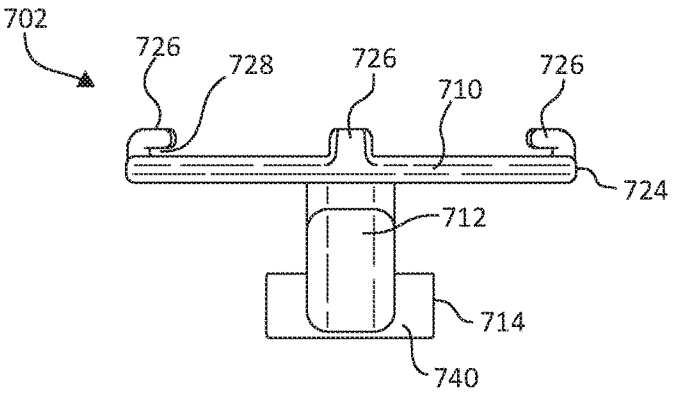
FIG. 26 is a top view illustration of the auxiliary identifier of FIG. 21, according to one embodiment of the present invention.
Figure 25:
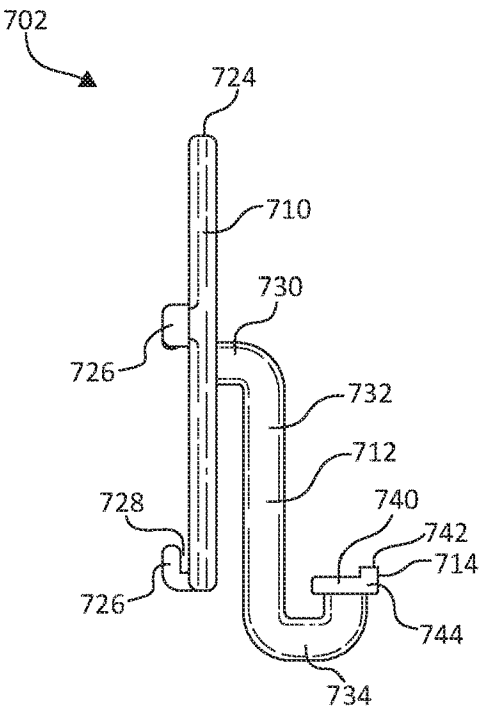
FIG. 25 is a right side view illustration of the auxiliary identifier of FIG. 21, according to one embodiment of the present invention.

FIG. 20 illustrates yet another example of a hanger assembly 698, according to one embodiment of the present invention, where hanger system 10 of FIG. 1 additionally includes an auxiliary identifier 700 configured to selectively couple with one or both of primary hangers 12 and 14 and/or one or more of auxiliary hanger 16, 29, and 20 to provide additional branding or other communicative information, such as department, sale, price, size, or other information to potential consumers. Auxiliary identifier 700 is configured to couple with primary hanger 12, as described below, or via coupling cavity 94 and/or primary hanger 14 via coupling cavity 394 as will be apparent to those of skill in the art upon reading the below description.

Additionally, referring to FIGS. 21-27, auxiliary identifier 700 includes indicia mount 702 and, in one example, a media member 704, such as a sign insert. In one embodiment, media member 704 is eliminated from auxiliary identifier 700. Indicia mount 702 is configured to be selectively coupled with primary hangers 12 and 14, and in one embodiment, one or more of auxiliary hangers 16, 18, and 20 via coupling cavities 94, 294, 394, 494, and 594, respectively. In one example, indicia mount 702 includes a primary panel 710, a depending arm 712, and a latch member 714. Primary panel 710 is substantially planar and of any suitable size and shape. In one example, primary panel 710 is sized smaller in overall dimension than hook 30.

Primary panel 710 defines a front surface 720 and a rear surface 722, opposite front surface 720. Front surface 720 is configured to support indicia 716 printed, adhered, or otherwise secured thereto and/or indicia 718 included on a front surface 719 of media member 704 providing identifying, marketing, sale, or other communicative information to a potential consumer viewing hanger assembly 698. In one example, such as where indicia 716 is eliminated from front surface 720, hooks 726 extend from a perimeter 724 of primary panel 710 slightly forwardly and radially inwardly over primary panel 710 forming a gap 728 between each hook 726 and primary panel 710. Hooks 726 included two or more hooks 726 circumferentially and/or otherwise suitably spaced about perimeter 724 to receive and hold media member 704 slid into gaps 728 from a top thereof.

Depending arm 712 extends from rear surface 722 of primary panel 710 of indicia mount 702 rearwardly and downwardly to couple with primary hanger 12. More specifically, in one embodiment, depending arm 712 includes a top arm segment 730, a substantially vertical arm segment 732, and a bottom arm segment 734. Top arm segment 730 rearwardly extends from rear surface 722 of primary panel 710, for example, from near a center thereof to provide spacing between primary panel 710 and front-facing 68 of hanger 14. Substantially vertical arm segment 732 extends from an end of top arm segment 730 opposite primary panel 710 to a point below a bottom of primary panel 710, in one example. Substantially vertical arm segment 732 provides placement of primary panel 710 just in front of vertex 52 of primary hanger 14 during use as shown in FIG. 20.

Bottom arm segment 734 of depending arm 712 extends rearwardly, in one example, followed by upwardly, from a bottom end of substantially vertical arm segment 732 opposite top arm segment 730 to latch member 714. Bottom arm segment 734 is sized and spaced to position latch member 714 to interact with coupling cavity 94 of primary hanger 12. Latch member 714, in one embodiment, includes a bottom panel 740 and a substantially vertical panel 742 each extending between side edges 744 of latch member 714. Bottom panel 740 is coupled to a top of bottom arm segment 734 and provides a base for substantially vertical panel 742 to extend upwardly therefrom. Latch member 714 is sized and shape to tightly slide into coupling cavity 94 such that side edges 744 fit tightly against interior side walls 92 of coupling cavity 94. In one example, the overall front-to-back depth of bottom panel 740 is substantially identical to a distance between first panel 62 and second panel 64 such that front edge 746 and opposite back edge 748 of latch member 714 tightly interact with rear-facing surface 66 of first panel and front-facing surface 72 of second panel 64. In one embodiment, since latch member 714 does not support a garment or item of significant weight, the friction fit between latch member 714 and coupling cavity 94 is sufficient to maintain primary panel 710 in its desired position, e.g., substantially in front of vertex 52.

During use, latch member 714 is pressed upwardly into coupling cavity 94 to form a friction fit coupling between indicia support 702 and hanger 12. Upon assembly, in one embodiment, primary panel 710 extends in front of vertex 52. In one example, where primary panel 710 includes indicia 718 media member 704 is eliminated. In one example, indicia are included on media member 704, and media member 704 is slid into place in front of primary panel 710 and held in place by hooks 726 in gaps 728. In one example, where media member 704 is eliminated, so are hooks 726.

Figure 28:
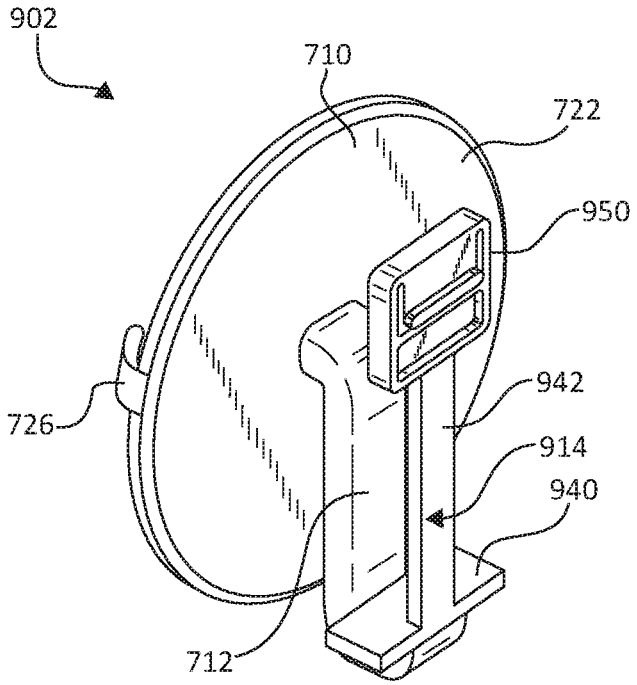
FIG. 28 is a rear perspective view illustration of an auxiliary identifier, according to one embodiment of the present invention.

FIG. 28 illustrates an indicia support 902 according to another embodiment. Indicia support 902 includes primary panel 710, depending arm 712, and latch member 914 with like parts as compared to indicia mount 702 including like reference numerals. Much like latch member 714 (FIGS. 21-27), latch member 914 extends from an end of depending arm 712 opposite primary panel 710. In one example, latch member 914 includes a bottom panel 940, a substantially vertical extension 942, and clip 950. Bottom panel 940 is coupled to a top of bottom arm segment 734 and provides a base for substantially vertical extension 942 to extend upwardly therefrom. Clip 950 is sized, shaped, and/or otherwise formed substantially identically to first clip 100 (see FIGS. 5-13) of coupling member 22 and therefore is configured to be selectively received in any one of coupling cavity 94, 294, 394, 494, and 594 of any of primary hangers 12 and 14 and/or auxiliary hangers 16, 18, and 20 in a substantially identical manner as described above with respect to first clip 100.

During use, clip 950 of latch member 914 is pressed upwardly into coupling cavity 94 to form a friction fit coupling between indicia support 902 and hanger 12. Upon assembly, in one embodiment, primary panel 710 extends in front of vertex 52 of hanger 12.

The innovation, for example, as described in the embodiments above, provides a hanger system that is flexible to handle any number of garment collections, that is groups of two or more garments, supported by a single support rod via a single hook of a hanger assembly. The hanger assembly provides two pairs of arms (one pair of arm on each of the two assembled hangers), with each pair of arms configured to support a garment and a coupling member vertically coupling and spacing the pair of arms from each other. The versatility of the hanger system allows a large number of hanger assemblies to be made from a collection of primary hangers and auxiliary hangers, thereby, decreasing the overall inventory needed to store hangers for displaying the desired garments in a retail space, especially where such hangers are reusable and maybe be used alone and/or in different hanger assemblies, that is with a different corresponding primary or auxiliary hanger, in the future. In one embodiment, coupling members are selectively couplable with each primary hanger and auxiliary hanger to allow hanger assemblies to be deconstructed and reconstructed with different primary hanger and auxiliary hanger pairings as a user deems appropriate.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A hanger assembly comprising:

a primary hanger including:

a hook configured to selectively receive a support rod;

a pair of arms coupled to the hook and extending outwardly therefrom to form two, opposite free arm ends, wherein the pair of arms defines an interior coupling cavity extending into an interior of the pair of arms upwardly from bottom edges of the pair of arms;

an auxiliary hanger configured to support a garment; and a coupling member defining a first end and a second end opposite and spaced from the first end, the first end including a first clip selectively secured within the interior coupling cavity of the primary hanger above the bottom edges of the pair of arms, and the second end is secured to the auxiliary hanger;

wherein the pair of arms includes a first primary panel, forming one of a front face and a rear face of the primary hanger, and a second primary panel forming the other of the front face and the rear face of the primary hanger, the interior coupling cavity is formed between the first primary panel and the second primary panel.

2. The hanger assembly of claim 1, wherein the interior coupling cavity includes an opening thereto formed adjacent the bottom edges of the pair of arms, and the coupling member includes an elongated segment extending from the first clip, out of the opening, and to the second end of the coupling member.

3. The hanger assembly of claim 1, wherein the first clip is substantially hidden from view within the interior coupling cavity.

4. The hanger assembly of claim 1, wherein at least one of the first primary panel and the second primary panel defines an aperture in an interior portion of the one of the first primary panel and the second primary panel, the first clip includes a coupling tab with a protruding flange, and the protruding flange is secured within the aperture.

5. The hanger assembly of claim 1, wherein the first primary panel extends substantially continuously between the two, opposite free arm ends.

6. The hanger assembly of claim 5, wherein the second primary panel extends substantially continuously between the two, opposite free arm ends.

7. The hanger assembly of claim 1, wherein the interior coupling cavity is formed adjacent to each of the first primary panel and the second primary panel.

8. The hanger assembly of claim 1, wherein the second primary panel defines an aperture in an interior portion thereof, the aperture is in communication with the interior coupling cavity, the first clip includes a coupling tab with a protruding flange, and the protruding flange is secured within the aperture.

9. The hanger assembly of claim 8, wherein the first primary panel defines one or more rails extending into the interior coupling cavity, the one or more rails contacting the coupling tab opposite the protruding flange to facilitate securement of the flange within the aperture.

10. The hanger assembly of claim 1, wherein interior sidewalls extend from and between the first primary panel and the second primary panel on opposite sides of and adjacent to the interior coupling cavity, and the first clip snugly interacts with the interior sidewalls to facilitate coupling of the coupling member and the primary hanger.

11. The hanger assembly of claim 1, wherein the auxiliary hanger is characterized by an absence of a hook for hanging the auxiliary hanger.

12. The hanger assembly of claim 1, wherein the interior coupling cavity is a first interior coupling cavity, the auxiliary hanger includes a second interior coupling cavity being open toward and extending downwardly from a top surface of the auxiliary hanger, the coupling member includes a second clip at the second end thereof, the second clip being substantially maintained within the second interior coupling cavity to couple the auxiliary hanger to the primary hanger via the coupling member.

13. The hanger assembly of claim 12, wherein the second clip is selectively secured within the second coupling member.

14. The hanger assembly of claim 13, wherein the first clip is substantially hidden from view within the first interior coupling cavity, and the second clip is substantially hidden from view within the second interior coupling cavity.

15. The hanger assembly of claim 1, wherein:

the primary hanger is a first primary hanger, the auxiliary hanger is a first auxiliary hanger, the interior coupling cavity is a first interior coupling cavity, and the hanger assembly is provided in combination with a second primary hanger having a different geometry than the first primary hanger and a second auxiliary member having a different geometry than the first auxiliary hanger, and the second primary hanger defines a second interior coupling cavity configured to selectively be coupled with the first clip.

16. The hanger assembly of claim 1, wherein at least one of the primary hanger and the auxiliary hanger includes one of clamps and clips for securing a garment to the at least one of the primary hanger and the auxiliary hanger.

17. A hanger system comprising:

a first primary hanger including:

a hook configured to selectively receive a support rod;

two opposite panels collectively defining one or more arms for supporting a garment, each of the two opposite panels includes a bottom edge continuously extending along a bottom perimeter of the one or more arms from a first end of the one or more arms to a second end of the one or more arms, the second end being positioned opposite the first end and on an opposite side of the hook relative to the first end, wherein the one or more arms defines an interior coupling cavity formed above the bottom edge of each of the one or more arms, extending upwardly toward the hook into an interior of the one or more arms, such that the interior coupling cavity is substantially hidden behind one of the one or more arms;

an auxiliary hanger configured to support a garment, a coupling member defining a first end and a second end opposite and spaced from the first end, wherein the first end includes a first clip configured to be selectively secured within the interior coupling cavity of the first primary hanger such that the first clip is substantially hidden from view by the one or more arms.

18. The hanger system of claim 17, wherein the pair of arms of the first primary hanger includes a first primary panel, forming one of a front face and a rear face of the first primary hanger, and a second primary panel forming the other of the front face and the rear face of the first primary hanger, the interior coupling cavity is formed between the first primary panel and the second primary panel.

19. The hanger system of claim 18, wherein the second primary panel defines an aperture in an interior portion thereof, the aperture is in communication with the interior coupling cavity, the first clip includes a coupling tab with a protruding flange, and the protruding flange is secured within the aperture.

* * * * *